US006012807A

United States Patent [19]

Olsen et al.

[11] Patent Number: 6,012,807

[45] Date of Patent: Jan. 11, 2000

[54] INK CONTAINMENT UNIT FOR USE IN AN INK DELIVERY SYSTEM

[75] Inventors: David Olsen; Edward Z. Cai, both of Corvallis, Oreg.

[73] Assignee: Hewlett-Packard Company, Palo Alto, Calif.

[21] Appl. No.: 09/036,257

[22] Filed: Mar. 6, 1998

[51] Int. Cl.[7] ..... B41J 2/175

[52] U.S. Cl. ..... 347/85; 428/35.8; 428/35.9; 220/62.17; 220/62.22

[58] Field of Search ..... 347/85, 86; 220/62.17, 220/62.22; 383/113, 116; 428/35.3, 35.9, 35.8; 138/137

[56] References Cited

U.S. PATENT DOCUMENTS

| | | | |
|---|---|---|---|
| 4,329,698 | 5/1982 | Smith . | |
| 4,415,886 | 11/1983 | Kyogoku et al. | 101/366 X |
| 4,500,895 | 2/1985 | Buck et al. . | |
| 4,509,062 | 4/1985 | Low et al. . | |
| 4,606,951 | 8/1986 | Wakasugi et al. | 383/113 X |
| 4,740,402 | 4/1988 | Maeda et al. | 428/35.9 |
| 4,749,291 | 6/1988 | Kobayashi et al. . | |
| 4,771,295 | 9/1988 | Baker et al. . | |
| 4,794,409 | 12/1988 | Cowger et al. . | |
| 4,929,969 | 5/1990 | Morris . | |
| 4,944,850 | 7/1990 | Dion . | |
| 4,963,189 | 10/1990 | Hindagolla . | |
| 5,023,120 | 6/1991 | Akao | 428/35.9 |
| 5,110,642 | 5/1992 | Genske | 428/35.3 X |
| 5,110,643 | 5/1992 | Akao et al. | 428/35.9 |
| 5,153,612 | 10/1992 | Dunn et al. . | |
| 5,168,285 | 12/1992 | Winslow . | |
| 5,185,034 | 2/1993 | Webb et al. . | |
| 5,185,614 | 2/1993 | Courian et al. . | |
| 5,278,584 | 1/1994 | Keefe et al. . | |
| 5,280,300 | 1/1994 | Fong et al. . | |
| 5,433,982 | 7/1995 | Yamada et al. | 428/35.7 |
| 5,611,461 | 3/1997 | Kubota et al. | 347/86 X |
| 5,851,640 | 12/1998 | Schuhmann et al. | 428/35.7 X |
| 5,855,975 | 1/1999 | Miksic et al. | 428/35.9 X |
| 5,888,640 | 3/1999 | Marotta et al. | 428/35.9 X |

FOREIGN PATENT DOCUMENTS

| | | |
|---|---|---|
| 62-288045 | 12/1987 | Japan . |
| 2-111555 | 4/1990 | Japan . |

OTHER PUBLICATIONS

*Hewlett–Packard Journal*, vol. 39, No. 4 (Aug. 1988).

*Primary Examiner*—Matthew S. Smith

[57] ABSTRACT

An ink containment vessel characterized by improved resistance to the corrosive effects of ink and the ability to prevent air entry into the ink. The system also avoids the evaporative loss of volatile components from the ink supply. The ink containment vessel is produced from a unique multi-layer film product and is designed for use in an ink delivery system. The film includes at least one organic polymer layer and at least one layer of elemental silver. Various organic polymers may be incorporated into the film product in numerous layer arrangements including barrier compositions, sealants, and structural reinforcement materials. Also, an optional layer of a noble metal or hydrophobic compound may be employed to provide further durability. The storage of ink within the vessel offers multiple benefits as indicated above and substantially improves the operational efficiency of the entire ink delivery system.

29 Claims, 4 Drawing Sheets

INK CONTAINMENT UNIT FOR USE IN AN INK DELIVERY SYSTEM

BACKGROUND OF THE INVENTION

The present invention generally relates to ink printing technology, and more particularly to a specialized ink containment unit for use in an ink delivery system which is resistant to the corrosive effects of ink, prevents air entry into the ink, and avoids the evaporation of volatile ink components therefrom. As a result, the overall longevity and operational efficiency of the entire ink delivery system is improved.

Substantial developments have been made in the field of electronic printing technology. A wide variety of highly-efficient printing systems currently exist which are capable of dispensing ink in a rapid and accurate manner. Thermal inkjet systems are especially important in this regard. Printing units using thermal inkjet technology basically involve an apparatus which includes at least one ink reservoir chamber in fluid communication with a substrate (preferably made of silicon) having a plurality of thin-film heating resistors thereon. The substrate and resistors are maintained within a structure which is conventionally characterized as a "printhead"Selective activation of the resistors causes thermal excitation of the ink materials stored inside the reservoir chamber and expulsion thereof from the printhead. Representative thermal inkjet systems are discussed in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al.; U.S. Pat. No. 5,278,584 to Keefe et al.; and the *Hewlett-Packard Journal,* Vol. 39, U.S. Pat. No. 4 (August 1988), all of which are incorporated herein by reference.

The ink delivery systems described above (and other systems using different ink ejection devices as discussed below) typically include an ink containment unit (e.g. a housing or vessel) having a self-contained supply of ink therein in order to form an ink cartridge. In a standard ink cartridge, the ink containment unit is directly attached to the remaining components of the cartridge to produce an integral and unitary structure wherein the ink supply is considered to be "on-board". However, in other cases, the ink containment unit will be provided at a remote location within the printer unit, with the containment unit being operatively connected to and in fluid communication with the printhead using one or more ink transfer conduits. These particular systems are conventionally known as "off-axis" printing units. The present invention shall be applicable to both of these designs, and may likewise be used in connection with ink printing devices that use non-thermal-inkjet technology. Accordingly, while the claimed invention shall be described herein with primary reference to thermal inkjet printing systems, it is likewise applicable to any ink delivery apparatus which employs a housing or vessel containing a supply of ink therein which has corrosive capabilities and volatile ink components.

An important consideration in the development of an ink containment unit for use with a thermal inkjet (or other type) of printing system is the ability of the containment unit to avoid substantial air introduction into the ink supply and printhead. Excessive air introduction (when reaching a critical volume) can cause a loss of system back-pressure which will typically result in operational failure of the ink ejection components and reduce overall printhead life. It is also important to prevent the evaporation of volatile components from the ink supply, with these components including water and organic solvents such as 2-pyrrolidone, 1,5-pentanediol, N-methyl pyrrolidone, 2-propanol, 2-ethyl-2-hydroxymethyl-1,3-propanediol, cyclohexanol, and others as discussed in considerable detail below. Solvent evaporation can result in a chemical deterioration of the ink supply which will reduce overall print quality and can cause premature failure of the ink delivery printhead. Accordingly, these factors must be carefully considered in any ink delivery system regardless of whether the ink containment unit (e.g. housing or vessel) is of the "on-board" variety or remotely positioned from the printhead.

Many ink cartridge units have employed rigid, thick-walled ink storage housings for containing ink therein which is present in "free flowing", unconstrained form or held within a multi-cellular foam-type member. Representative ink cartridge units which employ these types of ink containment systems are illustrated in U.S. Pat. Nos. 5,185,614 and 5,168,285 which are incorporated herein by reference. The housing units described above (which traditionally have effective gas/vapor barrier properties) are constructed from a number of different materials including glass, polytetrafluoroethylene (Teflon®), stainless steel, or various plastics including polystyrene and polycarbonate compositions. While these materials typically have good barrier capabilities as previously noted, their rigid and "non-collapsible" character requires the introduction of air or other gaseous materials into the system when ink delivery occurs to overcome negative pressure effects which can cause the interruption of ink flow.

Other ink delivery systems have employed flexible ink containment structures in the form of bags or bladders constructed of film-type compositions which are typically retained inside a rigid housing. The flexibility of these ink containment structures allows them to deliver ink materials without the need to introduce air and/or other gases into the system under consideration. Representative ink cartridge units which employ this type of "flexible" ink containment unit are illustrated in U.S. Pat. Nos. 5,153,612 and 5,280,300, as well as co-pending (and co-owned) Pending U.S. application Ser. No. 08/869,446 which are all incorporated herein by reference.

While flexible, bag-type systems offer numerous advantages, they are nonetheless subject to undesired air leakage into the ink supply and ink evaporation problems. In addition to air leakage and evaporation problems, these systems are also subject to damage caused by the corrosive effects of ink materials normally used in modern printing systems. As a result, film deterioration (and ink leakage) can occur, with these problems being caused by a number of "corrosive" ink ingredients including but not limited to one or more of the organic solvent materials listed above, as well as various acidic dye compounds.

A substantial need has therefore existed for an ink containment unit which can be produced in flexible form, yet is capable of strong resistance to ink corrosion problems, prevents air from entering the ink supply, and avoids the evaporation of volatile ink components including organic solvents and water. The present invention described below solves these problems in a unique and highly effective manner. Specifically, a novel film product, an ink containment vessel produced therefrom, an ink delivery system using the vessel, and an ink evaporation/air entry control method are all disclosed which provide many important benefits. These benefits include (1) the avoidance of ink corrosion problems and ink leakage from the system; (2) the prevention of air entry into the ink supply and printhead; and (3) the control of ink evaporation and losses of volatile ink components. As a result, high levels of operating efficiency, print quality, and longevity are maintained in connection with the ink delivery system under consideration. These and other benefits associated with the claimed invention (as well as the specific details thereof) shall be discussed in considerable detail below.

SUMMARY OF THE INVENTION

It is an object of the present invention to provide an ink delivery system of improved operating efficiency and longevity.

It is another object of the invention to provide an improved ink containment vessel for use in an ink delivery system which is applicable to a wide variety of different systems including both thermal inkjet and non-thermal-inkjet units.

It is another object of the invention to provide an improved ink containment vessel for use in an ink delivery system which employs ink supplies that are either on-board (e.g. directly attached to the system printhead) or remotely connected to the printhead.

It is another object of the invention to provide an improved ink containment vessel for use in an ink delivery system which is resistant to the corrosive effects of ink compositions.

It is another object of the invention to provide an improved ink containment vessel for use in an ink delivery system which prevents the introduction of air into the vessel so that high levels of print quality and prolonged printhead longevity can be maintained.

It is a further object of the invention to provide an improved ink containment vessel for use in an ink delivery system which controls the evaporation of volatile ink components (including organic solvents and water) from the ink supply contained within the vessel.

It is a still further object of the invention to provide an improved ink containment vessel for use in an ink delivery system which is durable, corrosion resistant, flexible, and capable of effective use in a wide variety of ink delivery systems.

It is an even further object of the invention to provide an improved ink containment vessel for use in an ink delivery system which is readily manufactured in a cost-effective manner using mass-production techniques.

It is an even further object of the invention to provide an improved ink containment vessel for use in an ink delivery system which is capable of providing the benefits listed above in connection with many different ink compositions having multiple ingredients therein.

It is even further object of the invention to provide an improved ink containment vessel for use in an ink delivery system which is capable of being fabricated in many different shapes, sizes, capacities, and design configurations so that the vessel can be employed in multiple printing systems including self-contained thermal inkjet cartridges.

It is an even further object of the invention to provide a multi-layer film product of unique design and functional capability which may be used to construct the novel ink containment vessels described herein.

It is an even further object of the invention to provide an ink delivery system in the form of a printhead having the claimed ink containment vessel operatively connected thereto so that the foregoing benefits can be achieved.

It is a still further object of the invention to provide an effective method for preventing the introduction of air into an ink supply within an ink delivery system and controlling the evaporation of volatile ink components therefrom by retaining the ink supply inside the novel ink containment vessels discussed above.

The specialized ink-resistant film products, ink containment vessels made from the film products, ink delivery systems incorporating the vessels, and other important aspects of the claimed invention will now be summarized. More detailed information along with a discussion of specific construction materials and processing parameters will be provided below in the Detailed Description of Preferred Embodiments section.

In accordance with the present invention, a unique and highly effective multi-layer film product is disclosed which is designed for use as an ink containment vessel in an ink delivery system. The term "ink delivery system" shall, without limitation, involve a wide variety of different devices including cartridge units of the "self-contained" variety having a supply of ink stored directly therein. Also encompassed within this term are printing units which employ a printhead connected by one or more conduit members (or similar structures) to a remotely-positioned ink containment unit in the form of a tank, vessel, housing, or other structure.

The novel ink containment vessels described herein which are made from the claimed film compositions shall also not be restricted to any particular sizes, shapes, capacities, or overall configurations which shall be selected in accordance with the particular ink delivery system under consideration. Finally, while the present invention shall be discussed below with reference to systems employing thermal inkjet technology, it is likewise applicable to any other type of non-thermal-inkjet printing systems (examples provided below) which include a supply of ink that can cause the problems listed above (e.g. corrosion, evaporation of volatile ink components, and the like). Thus, in its broadest sense, the invention described and claimed herein is widely applicable to a diverse group of printing systems, applications, and environments.

The ink containment vessels made from the novel film products which are directly or remotely attached to a printhead (e.g. of the thermal inkjet variety) include an internal cavity surrounded by a side wall. The side wall is optimally of unitary, single-piece construction and is likewise highly flexible so that it may appropriately "collapse" during ink delivery. The film products that are used to construct the side wall are characterized by their ability to (1) overcome the corrosive effects of ink materials; (2) prevent the introduction of air into the ink supply contained within the vessel under consideration; and (3) avoid the evaporation and "escape" of volatile ink components including organic solvents and water from the ink. In this regard, the claimed film products and ink containment vessels represent a substantial advance in printing technology which will be readily apparent from the following discussion. As a further preliminary note, the term "vessel" as used herein shall be broadly construed to encompass any type of containment chamber, housing, or receptacle which is suitable for storing a supply of ink therein prior to and/or during delivery. While the preferred vessel in this case is soft and flexible in character, it will likewise encompass more rigid structures which may be appropriate in particular applications.

The film products described herein (and the unique ink containment vessels produced therefrom) again involve a unique, multi-component laminate structure which includes a plurality of material layers which cooperate to form a completed structure that prevents air and volatile ink components from passing therethrough. The plurality of material layers (in its broadest sense) includes (1) at least one layer constructed from an organic polymer composition, with the term "organic polymer" being defined in a conventional manner to involve a complex carbon-containing molecule which includes a plurality of repeating structural units; and (2) at least one layer of made entirely or partially of elemental silver [Ag]. The layer of elemental silver contributes to the unique features of the completed film products as previously discussed including their corrosion resistance and ability to prevent the passage of gaseous materials therethrough. For the purposes of this invention "corrosion" shall be defined to encompass a condition which involves the chemical and/or physical deterioration of the compositions under consideration.

It is important to emphasize that the present invention shall not be restricted to any number, order, or arrangement of layers within the completed film products. A wide variety of different layering arrangements will work effectively for the purposes recited herein provided that the final film products (and containment vessels produced therefrom) again include (1) at least one layer constructed from an organic polymer composition, with the term "polymer" being previously defined; and (2) at least one layer of elemental silver. Any description of particular materials, layering arrangements, or layer numbers relative to the completed film products and ink containment vessels is provided for example purposes only and shall not restrict the scope of this invention.

While the film products of interest will necessarily encompass a wide variety of different layers secured together in multiple arrangements, optimum results will be achieved if the metallic layer of elemental silver is combined (in varying configurations and layer-orders) with three (3) specific types of organic polymer compositions. Each of the completed film products (and ink containment vessels produced therefrom) will therefore preferably include the following organic polymer components/layers:

1. At least one "structural support layer" which shall be defined to involve a layer (and components used therein) which provide mechanical strength and tear-resistance to the completed film products and ink containment vessels. Representative and non-limiting organic polymers which may be employed for this purpose (which are specifically designated herein as "organic polymer reinforcement compositions") include but are not limited to polyester, nylon, polypropylene, polyethylene, and mixtures thereof. A preferred thickness value associated with the structural support layer in all embodiments of the invention involves, without limitation, about 0.00025–0.001 inches (optimum=about 0.0004–0.0007 inches).

2. At least one "sealant layer" which is optimally used as the innermost, ink-contacting layer in the completed ink containment vessel that is secured by "sealing" to the surrounding components of the ink delivery system. The sealant layer is constructed from at least one "organic polymer sealant composition" which is chemically capable of being attached by conventional "heat-staking" methods (defined below) or other thermal attachment processes (as well as adhesive affixation techniques) to itself or to various plastic parts in the ink delivery system of interest. In this manner, an ink containment vessel is formed which is "sealed" in character. Representative and non-limiting examples of materials which are encompassed within the term "organic polymer sealant composition" include but are not limited to polyethylene vinyl acetate, polyethylene, polypropylene, and mixtures thereof. To provide best results, these materials (and other suitable compositions) should have a melting temperature of about 120–200° C., although the invention shall not be restricted to materials which melt within this range. A preferred thickness value associated with the sealant layer in all embodiments of the invention involves, without limitation, about 0.0004–0.004 inches (optimum=about 0.0005–0.002 inches).

3. A "barrier layer" constructed of at least one "bi-axially oriented organic polymer barrier composition", with this layer being used to provide enhanced resistance to the passage of both liquid and gaseous materials therethrough (including air and volatile ink components). Likewise, the barrier layer is optimally used as a bonding surface for application of the metallic layer comprised of elemental silver thereto. Bonding of the metallic layer to the barrier layer is facilitated by the bi-axial character of the materials used to construct the barrier layer. In particular, the "bi-axially oriented organic polymer barrier composition" used to form the barrier layer shall involve organic polymer compounds which are sufficiently smooth and compatible with the metallic layer to allow the direct deposition of silver on the barrier layer using, for example, standard high-voltage sputtering deposition or vapor deposition technology. The term "bi-axially oriented" as used herein shall involve a structural configuration in which molecules within the bi-axial compositions of interest travel in different directions (both lengthwise and crosswise) compared with linear structures that incorporate molecules which are all aligned in one direction. The formation of bi-axial structures during production of the desired polymeric materials (which involves the precise control of molecular orientations within the compositions) provides improved strength and stability, as well as reduced elasticity. Likewise, the use of "bi-axially oriented" materials in this particular layer is desired because they will substantially prevent the cracking and loss of barrier properties associated with metallic layers applied thereto which may occur if non-biaxially oriented materials are employed. Representative and non-limiting examples of "bi-axially oriented organic polymer barrier materials" which may be used in the claimed film products and ink containment vessels produced therefrom include but are not limited to bi-axially oriented polypropylene, bi-axially oriented nylon, bi-axially oriented polyester, and mixtures thereof which are all commercially-available products. A preferred thickness value associated with the barrier layer in all embodiments of the invention involves, without limitation, about 0.00025–0.001 inches (optimum=about 0.0004–0.0007 inches).

The metallic layer made partially or (in a preferred embodiment) entirely of elemental silver has a non-limiting, representative thickness value of about 0.02–0.10 micrometers (optimum=about 0.03–0.07 micrometers). It should also be noted that certain additional layers may be employed within the plurality of material layers used to produce the claimed film products. These additional layers (which are optional and selected in accordance with routine preliminary pilot testing involving the particular ink containment vessels and ink materials of interest) include the following items:

A. At least one "protective layer" produced from a selected "hydrophobic composition". The protective layer is designed for placement within the selected film products to enhance the corrosion resistance of the metallic layer of elemental silver (and to avoid the formation of yellow-colored "corrosion spots" thereon). The term "hydrophobic" as used herein shall involve a composition which does not absorb or transmit water therethrough. Representative and non-limiting materials which may be employed as "hydrophobic compositions" within the protective layer include but are not limited to polyurethane, perfluoroated polyacrylates, epoxy polymers, silane coupling agents, silicone polymers, and mixtures thereof. A preferred thickness value associated with the protective layer in all embodiments of the invention involves, without limitation, about 0.00025–0.001 inches (optimum=about 0.0004–0.0007 inches). The protective layer of the selected "hydrophobic composition" shall optimally be positioned on top of (e.g. over) the surface of the metallic layer of elemental silver in order to protect it from corrosion as discussed further below. However, the invention shall not be restricted to the placement of this particular layer in any location or orientation within the completed film products and ink containment vessels.

B. At least one "metal-containing corrosion-control layer" constructed from at least one or more elemental noble metals. The term "noble metal" shall be defined in a conventional manner and will involve the following elemental metals alone or in combination: Gold [Au], Platinum [Pt], Mercury [Hg], Palladium [Pd], Iridium [Tr], Rhodium [Rh], Ruthenium [Ru], and Osmium [Os] with gold and platinum being best. An optimum thickness value associated with the corrosion-control layer in all embodiments of the invention involves, without limitation, about 0.02–0.10 micrometers (optimum=about 0.03–0.07 micrometers). The corrosion-control layer produced from the selected noble metal(s) shall optimally be positioned on top of (e.g. over) the surface of the metallic layer of elemental silver in order to protect it from corrosion as discussed below. The metal-containing corrosion-control layer can be used instead of or in addition to the protective layer of hydrophobic material. However, the present invention shall not be restricted to the placement of this particular layer in any location or orientation within the completed film products and ink containment vessels. It should also be noted that the metal-containing corrosion-control layer is optimally applied to the desired surface(s) within the claimed film products using conventional metal delivery processes including standard high-voltage sputter deposition or vapor deposition techniques.

As previously noted, the invention described herein shall not be restricted to any number, arrangement, sequence, or order of material layers, as well as the specific compositions associated with these layers unless otherwise noted herein. Many different combinations of materials and layer-orders are possible provided that the completed film products (and the side walls of the selected ink containment vessels) include one or more organic polymer layers and one or more layers containing elemental silver therein. Regarding attachment of the material layers together to yield a composite, laminate film product, many different conventional assembly methods are possible. For example, as previously discussed, initial delivery of the metal-containing layers (e.g. the metallic layer of elemental silver and [if used] the metal-containing corrosion-control layer produced from at least one elemental noble metal) is typically accomplished using standard high-voltage sputter deposition or vapor deposition techniques. In the alternative, metal foils can be applied using the conventional adhesive materials listed below in connection with attachment of the organic polymer layers together.

Regarding the various organic polymer layers in the film products, these layers are typically adhered together (and to the metal-containing layers listed above) using a layer of a selected adhesive composition. The adhesive composition is preferably applied to and between the particular layers which are to be attached together. This invention shall also not be restricted to any particular chemical adhesive compositions for this purpose. Representative (non-limiting) adhesives which may be employed include but are not limited to polyurethane and/or epoxy based adhesives (with or without optional "promoting agents" such as silane coupling compositions). Specific examples of these materials will be outlined below in the Detailed Description of Preferred Embodiments section. Each layer of adhesive material is preferably applied at a non-limiting, exemplary thickness range of about 0.00004–0.0004 inches (optimum=about 0.0001–0.0002 inches) using conventional adhesive application technology (roll-coating devices and the like).

While the film products and ink containment vessels described herein shall not be restricted to any particular arrangement or quantity of material layers as previously noted, a number of preferred embodiments are provided below for example purposes. These embodiments are as follows (with all of the various layer definitions, representative layer materials/compositions, and assembly techniques described above being entirely applicable and incorporated by reference relative thereto):

1. Example 1: (A) a structural support layer comprised of an organic polymer reinforcement composition [which is preferably used as the bottom or outermost layer of the film product which is exposed to the external environment in the ink containment vessel]; (B) a metallic layer comprised of elemental silver positioned over the structural support layer; (C) a barrier layer comprised of a bi-axially oriented organic polymer barrier composition positioned over the metallic layer; and (D) a sealant layer comprised of an organic polymer sealant composition positioned over the barrier layer [with the sealant layer preferably being attached to itself or to other plastic parts of common chemical origin within the ink delivery system to produce a sealed ink containment vessel]. In this regard, the sealant layer optimally functions as the innermost layer of the film product which is exposed to ink inside the completed ink containment vessel.

As discussed further below, this particular embodiment will involve a layering arrangement wherein the barrier layer is positioned between the sealant layer and the metallic layer comprised of elemental silver, with the metallic layer being positioned between the barrier layer and the structural support layer as shown in the accompanying drawing figures.

2. Example 2: (A) a structural support layer comprised of an organic polymer reinforcement composition [which is preferably used as the bottom or outermost layer of the film product exposed to the external environment in the ink containment vessel]; (B) a metallic layer comprised of elemental silver positioned over the structural support layer; (C) a metal-containing corrosion-control layer comprised of at least one elemental noble metal positioned over the metallic layer comprised of elemental silver; (D) a barrier layer comprised of a bi-axially oriented organic polymer barrier composition positioned over the metal-containing corrosion-control layer; and (E) a sealant layer comprised of an organic polymer sealant composition positioned over the barrier layer [with the sealant layer preferably being attached to itself or to other plastic parts of common chemical origin within the ink delivery system to produce a sealed ink containment vessel]. In this regard, the sealant layer optimally functions as the innermost layer of the film product which is exposed to ink inside the completed ink containment vessel.

Likewise, this particular embodiment will involve an optimal layering arrangement wherein the barrier layer is positioned between the sealant layer and the metallic layer comprised of elemental silver, with the metallic layer being positioned between the barrier layer and the structural support layer as illustrated in the accompanying drawing figures. Regarding the corrosion-control layer, it is positioned between the barrier layer and the metallic layer comprised of elemental silver.

3. Example 3: (A) a structural support layer comprised of an organic polymer reinforcement composition; (B) a metallic layer comprised of elemental silver positioned over the structural support layer; (C) a barrier layer comprised of a bi-axially oriented organic polymer barrier composition positioned over the metallic layer comprised of elemental silver; and (D) a sealant layer comprised of an organic polymer sealant composition positioned over the barrier layer [with the sealant layer preferably being attached to itself or to other plastic parts of common chemical origin within the ink delivery system to produce a sealed ink containment vessel]. In this regard, the sealant layer optimally functions as the innermost layer of the film product which is exposed to ink inside the completed ink containment vessel.

In addition to the layers provided above, further corrosion resistance and overall durability are provided by using two extra material layers in connection with the claimed structure in this Example. These two extra layers include (E) a supplemental metal-containing layer comprised partially or (more preferably) entirely of elemental silver which is positioned below the structural support layer; and (F) a supplemental sealant-containing layer positioned below the supplemental metal-containing layer which is comprised of an organic polymer sealant composition (e.g. of the same type listed above in connection with the main sealant layer). The supplemental metal-containing layer will optimally have the same thickness value(s) described above in connection with the main metallic layer comprised of elemental silver. Likewise, the supplemental sealant-containing layer will optimally have the same thickness value(s) associated with the main sealant layer. It should also be noted that, if desired, the metal-containing corrosion-control layer discussed above may also be employed within the multi-layer film product in this Example in substantially the same manner and orientation as described in Example 2.

In accordance with this particular embodiment, a layering arrangement is provided wherein the barrier layer is positioned between the sealant layer and the metallic layer comprised of elemental silver, with the metallic layer being positioned between the barrier layer and the structural support layer as shown in the accompanying drawing figures. Furthermore, the structural support layer is positioned between the metallic layer comprised of elemental silver and the supplemental metal-containing layer, with the supplemental metal-containing layer being positioned between the structural support layer and the supplemental sealant-containing layer (as again illustrated in the drawings summarized below).

4. Example 4: (A) a barrier layer comprised of a bi-axially oriented organic polymer barrier composition [which is preferably used as the bottom or outermost layer of the film product which is exposed to the external environment]; (B) a metallic layer comprised of elemental silver positioned over the barrier layer; (C) a structural support layer comprised of an organic polymer reinforcement composition positioned over the metallic layer comprised of elemental silver; and (D) a sealant layer comprised of an organic polymer sealant composition positioned over the structural support layer [with the sealant layer preferably being attached to itself or to other plastic parts of common chemical origin within the ink delivery system to produce a sealed ink containment vessel]. In this regard, the sealant layer preferably functions as the innermost layer of the film product which is exposed to ink inside the completed ink containment vessel.

As discussed further below, this particular embodiment will involve a layering arrangement wherein the structural support layer is positioned between the sealant layer and the metallic layer comprised of elemental silver, with the metallic layer being positioned between the structural support layer and the barrier layer.

5. Example 5: (A) a barrier layer comprised of a bi-axially oriented organic polymer barrier composition [which is preferably used as the bottom or outermost layer of the film product exposed to the external environment in the ink containment vessel]; (B) a metallic layer comprised of elemental silver positioned over the barrier layer; (C) a metal-containing corrosion-control layer comprised of at least one elemental noble metal positioned over the metallic layer comprised of elemental silver; (D) a structural support layer comprised of an organic polymer reinforcement composition positioned over the corrosion-control layer; and (E) a sealant layer comprised of an organic polymer sealant composition positioned over the structural support layer [with the sealant layer preferably being attached to itself or to other plastic parts of common chemical origin within the ink delivery system to produce a sealed ink containment vessel]. The sealant layer also optimally functions as the innermost layer of the film product which is exposed to ink inside the completed ink containment vessel.

In summary, this particular embodiment will involve a layering arrangement wherein the structural support layer is positioned between the sealant layer and the metallic layer comprised of elemental silver, with the metallic layer being positioned between the structural support layer and the barrier layer. Furthermore, the noble metal-containing corrosion-control layer is positioned between the structural support layer and the metallic layer comprised of elemental silver.

6. Example 6: (A) a barrier layer comprised of a bi-axially oriented organic polymer barrier composition [which is preferably used as the bottom or outermost layer of the film product exposed to the external environment in the ink containment vessel]; (B) a metallic layer comprised of elemental silver positioned over the barrier layer; (C) a protective layer comprised of a hydrophobic composition positioned over the metallic layer comprised of elemental silver; (D) a structural support layer comprised of an organic polymer reinforcement composition positioned over the protective layer; and (E) a sealant layer comprised of an organic polymer sealant composition positioned over the structural support layer [with the sealant layer preferably being attached to itself or to other plastic parts of common chemical origin within the ink delivery system to produce a sealed ink containment vessel]. The sealant layer again optimally functions as the innermost layer of the film product which is exposed to ink inside the completed ink containment vessel.

In effect, this particular embodiment will specifically involve a layering arrangement wherein the structural support layer is positioned between the sealant layer and the metallic layer comprised of elemental silver, with the metallic layer being positioned between the structural support layer and the barrier layer. Furthermore, the protective layer is positioned between the structural support layer and the metallic layer comprised of elemental silver.

All of the foregoing examples are representative only and shall not restrict the invention in any respect. Regarding the construction of an ink delivery system which incorporates the claimed film products and ink containment vessels produced therefrom (including those recited in Examples 1–6), many different systems (both thermal inkjet and non-thermal-inkjet) may be employed for this purpose including those described in the foregoing issued U.S. patents. A representative and preferred system will comprise a printhead having at least one ink ejector for expelling ink on demand from the printhead and an ink containment vessel operatively connected to and in fluid communication with the printhead. The ink containment vessel will include an internal cavity therein surrounded by a side wall which is used to retain an ink supply within the vessel. The side wall (which is specifically designed to prevent air and volatile ink components from passing therethrough) is constructed from the corrosion-resistant film products listed above which include a plurality of material layers. At a minimum, the plurality of material layers will comprise (1) at least one layer of an organic polymer composition; and (2) at least one layer consisting partially or entirely of elemental silver. In a preferred embodiment, the film product will optimally include (A) a structural support layer comprised of an organic polymer reinforcement composition; (B) a metallic layer comprised of elemental silver; (C) a barrier layer comprised of a bi-axially oriented organic polymer barrier composition; and (D) a sealant layer comprised of an organic polymer sealant composition (with particular reference to the term definitions provided above). The side wall may also be constructed from any of the specific structures listed in the foregoing Examples. Accordingly, the claimed ink delivery systems shall not be restricted to any specific layering arrangements, number of layers, layer sequences, or construction materials in connection with the selected film products/ink containment vessels unless otherwise stated herein.

Furthermore, the term "operatively connected" as used to define the interrelationship between the printhead and the ink containment vessel shall be broadly construed to encompass (A) a system in which the ink containment vessel is directly attached to and in fluid communication with the printhead to form, for example, a single cartridge unit having an "on-board" ink supply; and (B) a system in which the ink containment vessel is remotely spaced from the printhead and not "directly" attached thereto. In system (B), the ink containment vessel is preferably in fluid communication with the printhead using at least one ink supply/transfer conduit connected to and between the printhead and ink containment vessel. Both of these systems shall be applicable to all of the various embodiments of the claimed film products, ink containment vessels incorporating the film products, and methods for ink preservation presented below.

The invention described herein shall likewise encompass a general method for preventing the evaporation of volatile ink components (e.g. organic solvents and/or water) from an ink delivery system comprising a supply of ink therein. The claimed method shall also avoid the introduction of air into the ink supply. These goals are accomplished by: (1) providing an ink delivery system of the type discussed above which includes a printhead having at least one ink ejector for expelling ink on demand from the printhead; and (2) storing a supply of ink within an ink containment vessel operatively connected to and in fluid communication with the printhead wherein the ink containment vessel includes a side wall which prevents air and volatile ink components from passing therethrough. As previously noted, the side wall is constructed from a plurality of material layers secured together, with at least one of the material layers being produced from an organic polymer composition, and another of the material layers being made from elemental silver. The side wall of the ink containment vessel may also be constructed from any of the previously-described film products including those summarized in the foregoing Examples. Accordingly, all of the information presented above concerning representative ink delivery systems, ink containment vessels, and film products is incorporated by reference relative to the claimed method (s) which shall not be limited to any specific materials, layer arrangements, or other parameters unless otherwise noted herein.

The present invention represents a significant advance in the art of ink printing technology and the generation of high-quality printed images. The structures, components, and methods outlined in detail below provide many important benefits including: (1) the avoidance of ink corrosion problems and ink leakage from the ink delivery system; (2) the prevention of air entry into the ink supply and printhead; and (3) the control of ink evaporation and losses of volatile ink components. As a result, high levels of operating efficiency, print quality, and longevity are maintained in connection with the ink delivery system. These and other benefits, objects, features, and advantages will now be discussed in the following Brief Description of the Drawings and Detailed Description of Preferred Embodiments.

BRIEF DESCRIPTION OF THE DRAWINGS

Any reference numbers carried over from one drawing figure to other drawing figures shall constitute common subject matter applicable to all of the drawing figures under consideration. Likewise, the drawing figures presented herewith are shown in enlarged schematic format for illustrative purposes.

DETAILED DESCRIPTION OF PREFERRED EMBODIMENTS

Figure 1:
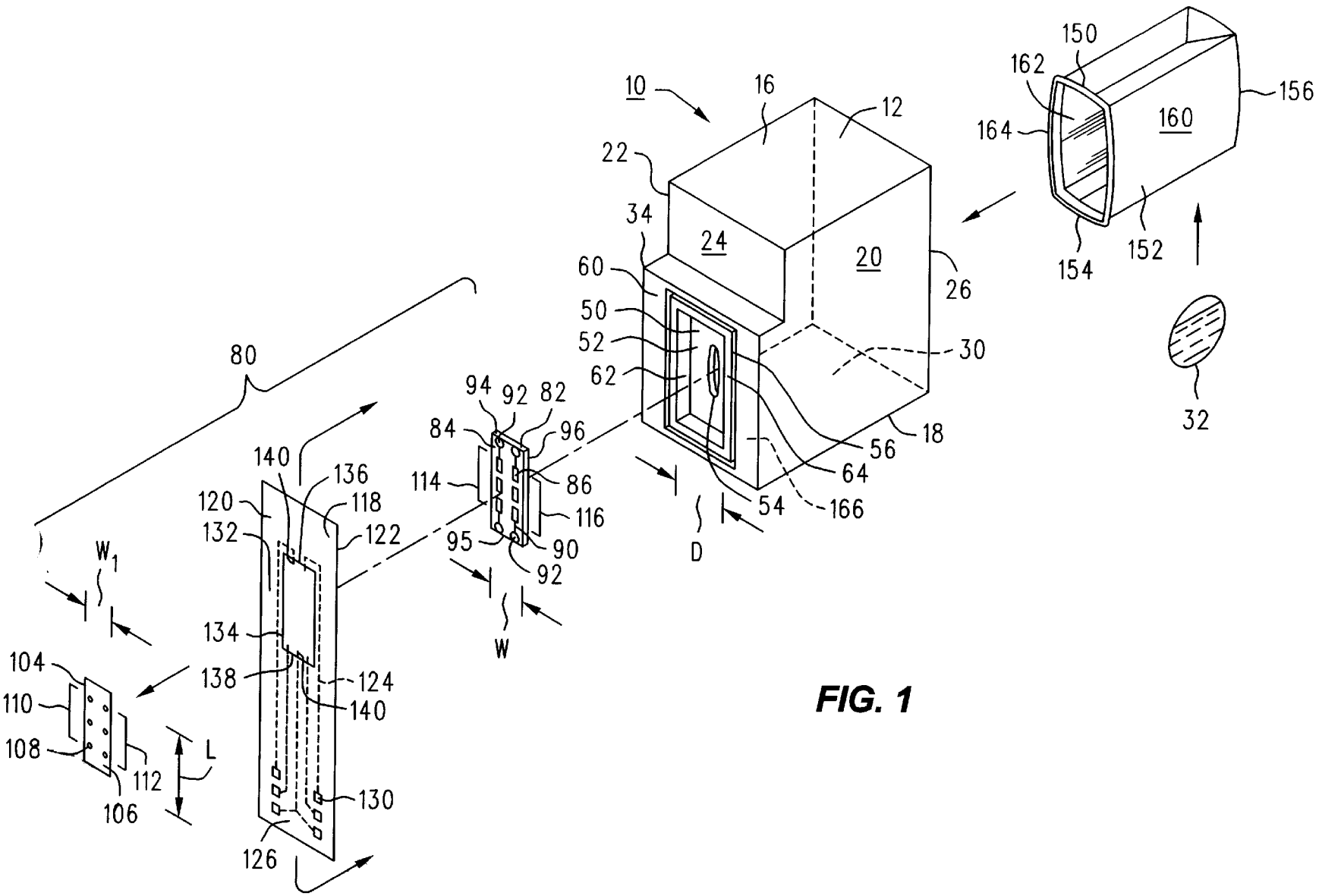
FIG. 1 is a schematically-illustrated, exploded perspective view of a representative ink delivery system in the form of an ink cartridge which is suitable for use with the components and methods of the present invention. The ink cartridge of FIG. 1 has an ink containment vessel directly attached to the cartridge so that an "on-board" ink supply is provided.

The present invention involves a high-durability ink containment vessel for use in ink delivery systems including those which employ thermal inkjet technology. The ink containment vessel is produced from a unique multi-layer laminate film product which (in a preferred embodiment) is flexible in nature and not subject to chemical deterioration caused by the corrosive effects of ink materials. Likewise, the film product substantially prevents the passage of air therethrough (and into the ink supply of interest) while simultaneously controlling the escape of volatile ink components including organic solvents and water. In this manner, the longevity of the entire printing system is enhanced along with the maintenance of high print quality levels. The claimed products and processes therefore represent an advance in the art of ink printing technology. While the invention shall be described below with primary reference to thermal inkjet technology, many different ink delivery systems may be employed in connection with the specialized components of the invention provided that the selected systems include a printhead having at least one ink ejector associated with the printhead. The term "ink ejector" shall involve any component, device, element, or structure which may be used to expel ink on-demand from the printhead. For example, in a thermal inkjet printing system, "ink ejector" will encompass the use of one or more selectively-energizable thin-film heating resistors as outlined in greater detail below. In this regard, the materials, methods, and structures of the invention are not "system-specific" which will become readily apparent from the detailed discussion presented herein. To provide a clear and complete understanding of the invention, the following description will be divided into three sections, namely, (1) "A. An Overview of Thermal Inkjet Technology and Ink Compositions Associated Therewith"; (2) "B. The Ink-Resistant Film Products and Ink Containment Vessels Produced Therefrom"; and (3) "C. Additional Information and Methods of Use."

A. An Overview of Thermal Inkjet Technology and Ink Compositions Associated Therewith The present invention is again applicable to a wide variety of ink cartridge systems which include (1) a printhead; (2) at least one "ink ejector" associated with the printhead; and (3) an ink containment vessel of the type described herein which is operatively connected to and in fluid communication with the printhead (either directly attached thereto or remotely connected to the printhead using one or more ink transfer conduits). As previously noted, the term "ink ejector" is defined to encompass any component, system, or device which selectively ejects or expels ink on-demand from the printhead. Thermal inkjet cartridges which use multiple heating resistors as ink ejectors are preferred for this purpose. However, the claimed invention shall not be restricted to any particular ink ejectors or ink printing technologies as stated above. A wide variety of different ink delivery devices may be encompassed within the claimed invention including but not limited to piezoelectric drop systems of the general type disclosed in U.S. Pat. No. 4,329,698 to Smith, dot matrix devices of the variety described in U.S. Pat. No. 4,749,291 to Kobayashi et al., as well as other comparable and functionally equivalent systems designed to deliver ink using one or more ink ejectors. The specific operating components associated with these alternative systems (e.g. the piezoelectric elements in the system of U.S. Pat. No. 4,329,698) shall be encompassed within the term "ink ejectors" as previously noted.

To facilitate a complete understanding of the claimed invention as it applies to thermal inkjet technology (which is the preferred system of primary interest), an overview of thermal inkjet technology will now be provided. A representative ink delivery system in the form of a thermal inkjet cartridge unit is illustrated in FIG. 1 at reference number 10. It shall be understood that cartridge 10 is presented herein for example purposes and is non-limiting. In addition, cartridge 10 is shown in schematic format in FIG. 1, with more detailed information regarding cartridge 10 and its various features (as well as similar systems) being provided in U.S. Pat. No. 4,500,895 to Buck et al.; U.S. Pat. No. 4,794,409 to Cowger et al.; U.S. Pat. No. 4,509,062 to Low et al.; U.S. Pat. No. 4,929,969 to Morris; U.S. Pat. No. 4,771,295 to Baker et al.; U.S. Pat. No. 5,278,584 to Keefe et al.; and the *Hewlett-Packard Journal,* Vol. 39, No. 4 (August 1988), all of which are incorporated herein by reference.

With continued reference to FIG. 1, the cartridge 10 first includes an ink storage housing 12 which is preferably manufactured from plastic (e.g. polystyrene, polycarbonate, and the like), metal, or a combination of both. The housing 12 further comprises a top wall 16, a bottom wall 18, a first side wall 20, and a second side wall 22. In the embodiment of FIG. 1, the top wall 16 and the bottom wall 18 are substantially parallel to each other. Likewise, the first side wall 20 and the second side wall 22 are also substantially parallel to each other.

The housing 12 further includes a front wall 24. Surrounded by the front wall 24, top wall 16, bottom wall 18, first side wall 20, and second side wall 22 is an interior chamber or compartment 30 within the housing 12 (shown in phantom lines in FIG. 1) which is designed to retain a supply of an ink composition 32 therein which, in many systems, is either in unconstrained (e.g. "free-flowing") form or retained within a multicellular foam-type structure. However, in the present embodiment which is designed to provide a number of important benefits, the ink cartridge 10 is of a type which includes a flexible, bladder-like ink containment vessel therein as discussed further below.

The front wall 24 further includes an externally-positioned, outwardly-extending printhead support structure 34 which comprises a substantially rectangular central cavity 50 therein. The central cavity 50 includes a bottom wall 52 shown in FIG. 1 with an ink outlet port 54 therein. The ink outlet port 54 passes entirely through the housing 12 and, as a result, communicates with the compartment 30 inside the housing 12 so that ink materials can flow outwardly from the compartment through the ink outlet port 54.

Also positioned within the central cavity 50 is a rectangular, upwardly-extending mounting frame 56, the function of which will be discussed below. As schematically shown in FIG. 1, the mounting frame 56 is substantially even (flush) with the front face 60 of the printhead support structure 34. The mounting frame 56 specifically includes dual, elongate side walls 62, 64.

With continued reference to FIG. 1, fixedly secured to housing 12 of the ink cartridge 10 (e.g. attached to the outwardly-extending printhead support structure 34) is a printhead generally designated in FIG. 1 at reference number 80. For the purposes of this invention and in accordance with conventional terminology, the printhead 80 actually comprises two main components fixedly secured together (with certain sub-components positioned therebetween). The first main component used to produce the printhead 80 consists of a substrate 82 preferably manufactured from silicon. Secured to the upper surface 84 of the substrate 82 using standard thin film fabrication techniques is a plurality of individually-energizable thin-film resistors 86 which function as "ink ejectors" and are preferably fabricated from a tantalum-aluminum composition known in the art for resistor construction. Only a small number of resistors 86 are shown in the schematic representation of FIG. 1, with the resistors 86 being presented in enlarged format for the sake of clarity. Also provided on the upper surface 84 of the substrate 82 using conventional photolithographic techniques is a plurality of metallic conductive traces 90 (e.g. circuit elements) which electrically communicate with the resistors 86. The conductive traces 90 likewise communicate with multiple metallic pad-like contact regions 92 positioned at the ends 94, 95 of the substrate 82 on the upper surface 84. The function of all these components which, in combination, are collectively designated herein as a "resistor assembly" 96 will be summarized further below.

Many different materials and design configurations may be used to construct the resistor assembly 96, with the present invention not being restricted to any particular elements, materials, and components for this purpose. However, in a preferred, representative, and non-limiting embodiment, the resistor assembly 96 will be approximately 0.5 inches long, and will likewise contain 300 resistors 86 thus enabling a resolution of 600 dots per inch ("DPI"). The substrate 82 containing the resistors 86 thereon will preferably have a width "W" (FIG. 1) which is less than the distance "D" between the side walls 62, 64 of the mounting frame 56. As a result, ink flow passageways are formed on both sides of the substrate 82 so that ink flowing from the ink outlet port 54 in the central cavity 50 can ultimately come in contact with the resistors 86. It should also be noted that the substrate 82 may include a number of other components thereon (not shown) depending on the type of ink cartridge 10 under consideration. For example, the substrate 82 may likewise comprise a plurality of logic transistors for precisely controlling operation of the resistors 86, as well as a "demultiplexer" of conventional configuration as discussed in U.S. Pat. No. 5,278,584. The demultiplexer is used to demultiplex incoming multiplexed signals and thereafter distribute these signals to the various thin film resistors 86. The use of a demultiplexer for this purpose enables a reduction in the complexity and quantity of the circuitry (e.g. contact regions 92 and traces 90) formed on the substrate 82.

Securely affixed to the upper surface 84 of the substrate 82 (with a number of intervening material layers therebetween including an ink barrier layer) is the second main component of the printhead 80. Specifically, an orifice plate 104 is provided as shown in FIG. 1 which is used to distribute the selected ink compositions to a designated print media material (e.g. paper). In accordance with the claimed invention, the orifice plate 104 consists of a panel member 106 (shown schematically in FIG. 1) which is manufactured from one or more metal compositions (e.g. gold-plated nickel [Ni] and the like). In a typical and non-limiting representative embodiment, the orifice plate 104 will have a length "L" of about 5–30 mm and a width "$W_1$" of about 3–15 mm. However, the claimed invention shall not be restricted to any particular orifice plate parameters unless otherwise indicated herein.

The orifice plate 104 further comprises at least one and preferably a plurality of openings or "orifices" therethrough which are designated at reference number 108. These orifices 108 are shown in enlarged format in FIG. 1. Each orifice 108 in a representative embodiment will have a diameter of about 0.01–0.05 mm. In the completed printhead 80, all of the components listed above are assembled so that each of the orifices 108 is aligned with at least one of the resistors 86 (e.g. "ink ejectors") on the substrate 82. As result, energization of a given resistor 86 will cause ink expulsion from the desired orifice 108 through the orifice plate 104. The claimed invention shall not be limited to any particular size, shape, or dimensional characteristics in connection with the orifice plate 104 and shall likewise not be restricted to any number or arrangement of orifices 108. In a representative embodiment as presented in FIG. 1, the orifices 108 are arranged in two rows 110, 112 on the panel member 106 associated with the orifice plate 104. If this arrangement of orifices 108 is employed, the resistors 86 on the resistor assembly 96 (e.g. the substrate 82) will also be arranged in two corresponding rows 114, 116 so that the rows 114, 116 of resistors 86 are in substantial registry with the rows 110, 112 of orifices 108. Further general information concerning this type of metallic orifice plate system is provided in, for example, U.S. Pat. No. 4,500,895 to Buck et al. which is incorporated herein by reference.

It should also be noted for background purposes that, while the primary embodiment of the invention is applicable to orifice plates produced entirely from metal compositions, alternative printing systems have effectively employed orifice plate structures constructed from non-metallic organic polymer compositions, with these structures typically having a representative and non-limiting thickness of about 1.0–2.0 mils. In this context, the term "non-metallic" will encompass a product which does not contain any elemental metals, metal alloys, or metal amalgams. The phrase "organic polymer" shall involve a long-chain carbon-containing structure of repeating chemical subunits as noted above. A number of different polymeric compositions may be employed for this purpose. For example, non-metallic orifice plate members may be manufactured from the following compositions: polytetrafluoroethylene (e.g. Teflon®), polyimide, polymethylmethacrylate, polycarbonate, polyester, polyamide, polyethyleneterephthalate, or mixtures thereof. Likewise, a representative commercial organic polymer (e.g. polyimide-based) composition which is suitable for constructing a non-metallic organic polymer-based orifice plate member in a thermal inkjet printing system is a product sold under the trademark "KAPTON" by the E.I. du Pont de Nemours & Company of Wilmington, Del. (USA). Further data regarding the use of non-metallic organic orifice plate systems is provided in U.S. Pat. No. 5,278,584.

With continued reference to FIG. 1, a film-type flexible circuit member 118 is likewise provided in connection with the cartridge 10 which is designed to "wrap around" the outwardly-extending printhead support structure 34 in the completed ink cartridge 10. Many different materials may be used to produce the circuit member 118, with representative (non-limiting) examples including polytetrafluoroethylene (e.g. Teflon®), polyimide, polymethylmethacrylate, polycarbonate, polyester, polyamide, polyethyleneterephthalate, or mixtures thereof. Likewise, a representative commercial organic polymer (e.g. polyimide-based) composition which is suitable for constructing the flexible circuit member 118 is a product sold under the trademark "KAPTON" by the E.I. du Pont de Nemours & Company of Wilmington, Del. (USA) as previously noted. The flexible circuit member 118 is secured to the printhead support structure 34 by adhesive affixation using conventional adhesive materials (e.g. epoxy resin compositions known in the art for this purpose). The flexible circuit member 118 enables electrical signals to be delivered and transmitted from the printer unit (not shown) to the resistors 86 (or other ink ejectors) on the substrate 82 as discussed below. The film-type flexible circuit member 118 further includes a top surface 120 and a bottom surface 122 (FIG. 1). Formed on the bottom surface 122 of the circuit member 118 and shown in dashed lines in FIG. 1 is a plurality of metallic (e.g. gold-plated copper) circuit traces 124 which are applied to the bottom surface 122 using known metal deposition and photolithographic techniques. Many different circuit trace patterns may be employed on the bottom surface 122 of the flexible circuit member 118, with the specific pattern depending on the particular type of ink cartridge 10 and printing system under consideration. Also provided at position 126 on the top surface 120 of the circuit member 118 is a plurality of metallic (e.g. gold-plated copper) contact pads 130. The contact pads 130 communicate with the underlying circuit traces 124 on the bottom surface 122 of the circuit member 118 via openings or "vias" (not shown) through the circuit member 118. During use of the ink cartridge 10 in a printer unit, the pads 130 come in contact with corresponding printer electrodes in order to transmit electrical control signals from the printer unit to the contact pads 130 and traces 124 on the circuit member 118 for ultimate delivery to the resistor assembly 96. Electrical communication between the resistor assembly 96 and the flexible circuit member 118 will again be outlined below.

Positioned within the middle region 132 of the film-type flexible circuit member 118 is a window 134 which is sized to receive the orifice plate 104 therein. As shown schematically in FIG. 1, the window 134 includes an upper longitudinal edge 136 and a lower longitudinal edge 138. Partially positioned within the window 134 at the upper and lower longitudinal edges 136, 138 are beam-type leads 140 which, in a representative embodiment, are gold-plated copper and constitute the terminal ends (e.g. the ends opposite the contact pads 130) of the circuit traces 124 positioned on the bottom surface 122 of the flexible circuit member 118. The leads 140 are designed for electrical connection by soldering, thermocompression bonding, and the like to the contact regions 92 on the upper surface 84 of the substrate 82 associated with the resistor assembly 96. As a result, electrical communication is established from the contact pads 130 to the resistor assembly 96 via the circuit traces 124 on the flexible circuit member 118. Electrical signals from the printer unit (not shown) can then travel via the conductive traces 90 on the substrate 82 to the resistors 86 so that on-demand heating (energization) of the resistors 86 can occur.

It is important to emphasize that the present invention shall not be restricted to the specific printhead 80 illustrated in FIG. 1 and discussed above, with many other printhead designs also being suitable for use in accordance with the claimed invention. The printhead 80 of FIG. 1 is provided for example purposes and shall not limit the invention in any respect. Likewise, it should also be noted that if a non-metallic organic polymer-type orifice plate system is desired, the orifice plate 104 and flexible circuit member 118 can be manufactured as a single unit as discussed in U.S. Pat. No. 5,278,584.

The final step in producing the completed printhead 80 involves physical attachment of the orifice plate 104 in position on the underlying portions of the printhead 80 so that the orifices 108 are in precise alignment with the resistors 86 on the substrate 82 as previously noted. Attachment of these components together may likewise be accomplished through the use of conventional adhesive materials (e.g. epoxy and/or cyanoacrylate adhesives known in the art for this purpose).

Finally, with continued reference to FIG. 1, the cartridge 10 includes a structure designated as an "ink containment vessel" shown schematically at reference number 150. The term "vessel" as used herein shall encompass any housing, receptacle, or storage chamber (flexible, non-flexible, or semi-flexible) which is used to retain ink therein for delivery by an ink printing system. The present invention shall not be restricted to placement of the ink containment vessel 150 within an outer housing 12 as shown in FIG. 1, although the use of such a housing 12 is preferred. The novel ink containment vessel 150 described further below is designed to receive a supply of ink therein in a manner which (1) avoids problems associated with deterioration of the vessel 150 caused by the corrosive effects of ink materials; (2) prevents air introduction into the ink supply retained within the vessel 150; and (3) avoids the escape of volatile and important ink ingredients including organic solvents (discussed further below). These goals are achieved through the use of specialized and unique film products to construct the vessel 150 which will be discussed in Section "B" of this disclosure.

As shown in FIG. 1, the ink containment vessel 150 is configured in the form of a bag or bladder-like structure which includes a main body portion 152 with an open first end 154 and a closed second end 156. The vessel 150 further comprises a continuous side wall 160 which, in the present invention, is produced from the specialized film products discussed below. The side wall 160 defines and surrounds an internal cavity 162 which is used to retain a supply of an ink composition 32 therein (also discussed below). It should be emphasized that the present invention shall not be restricted to an ink containment vessel 150 of any size, shape, or dimensional parameters. Likewise, while it is preferred that the vessel 150 be flexible in order to permit the collapse thereof during use, the vessel 150 may also be produced in a manner which increases its rigidity (e.g. by making the entire vessel thicker or using other known techniques for stiffening polymeric film products). Further data concerning the overall thickness of the side wall 160 (and film product [s] associated therewith) will be set forth below.

The ink containment vessel 150 is positioned within the housing 12 and (in a preferred embodiment) completely retained therein. Likewise, the peripheral edges 164 of the open first end 154 are fixedly secured to the inner surface 166 of the housing 12 adjacent the central cavity 50 so that the open first end 154 of the vessel 150 completely surrounds the ink outlet port 54 in a fluid-tight manner. Attachment of these components may be accomplished in any suitable manner including the use of a selected adhesive composition applied thereto (e.g. a conventional epoxy resin or cyanoacrylate material known in the art, as well as the specific adhesive compositions discussed below which are used to assemble the film products of the claimed invention). Alternatively, assembly may be achieved through the use of known thermal-sealing/heat-staking processes. Such processes typically involve the application of heat to both of the components of interest so that they thermally weld (e.g. melt) to each other. In this regard, the present invention shall not be restricted to any particular attachment methods or orientations relative to the ink containment vessel 150 provided that, in some manner, the ink supply (e.g. ink composition 32) within the internal cavity 162 of the vessel 150 (as well as the vessel 150 itself) is in fluid communication with the printhead 80 and its operating components. Such communication will occur via the ink outlet port 54 in the embodiment of FIG. 1.

The representation shown in FIG. 1 is schematic in nature and shall again not be regarded as limiting. Specific ink cartridge units of the type described above having flexible, bladder-like ink containment vessels therein are illustrated in U.S. Pat. Nos. 5,153,612 and 5,280,300 which are incorporated herein by reference. An exemplary commercially-available ink cartridge unit having a conventional flexible, bladder-like ink containment vessel therein can be obtained from the Hewlett-Packard Company of Palo Alto, Calif. (USA) under the product designation "51626A".

The components and materials discussed above in connection with FIG. 1 involve a "self-contained" ink delivery system which includes an "on-board" supply of ink. The claimed invention may likewise be used with other systems (both thermal inkjet and non-thermal-inkjet) which employ a printhead and a supply of ink stored within an ink containment vessel that is remotely spaced but operatively connected to and in fluid communication with the printhead. An example of such a system is disclosed in co-owned Pending U.S. application Ser. No. 08/869,446 filed Jun. 5, 1997 which is incorporated herein by reference. This type of "remote" system (which is basically known as an "off-axis" unit) involves a tank-like housing with a supply of ink therein that is operatively connected to and in fluid communication with a printhead containing at least one ink ejector as defined above. Representative ink ejectors comprise the resistor elements associated with thermal inkjet systems, as well as other devices including piezoelectric elements and the like. Accordingly, the main difference between the "remote" system discussed above and the apparatus FIG. 1 is the proximity and orientation of the ink containment vessel to the printhead.

Figure 2:
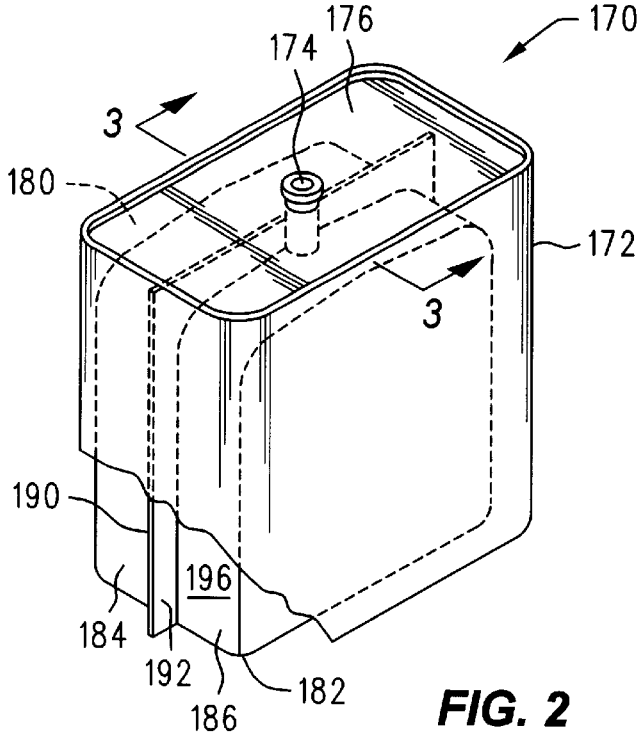
FIG. 2 is a schematically-illustrated perspective view (with portions broken away) of an alternative ink delivery system which is also suitable for use with the components and methods of the present invention. The system of FIG. 2 includes a remotely-positioned ink containment vessel that is operatively connected to a printhead using at least one ink transfer conduit.
Figure 3:
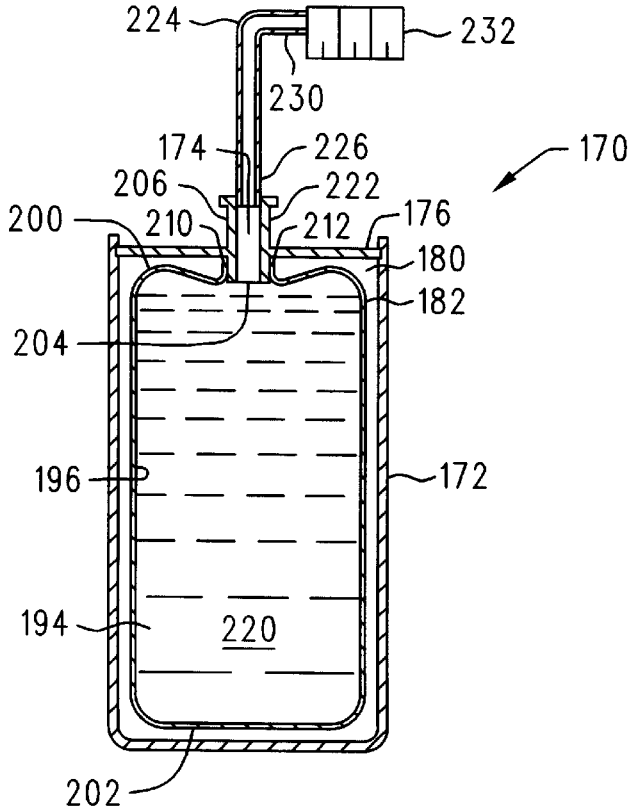
FIG. 3 is a partial cross-sectional view of the system shown in FIG. 2 taken along lines 3—3.

With reference to FIGS. 2–3, an ink delivery system is shown in the form of an ink storage unit 170 that is designed for remote, operative connection to a selected printhead. The printhead may be of a thermal inkjet type or other variety as previously noted. The ink storage unit 170 includes an outer shell or housing 172 made of metal, plastic, or a combination of both compositions which includes an inlet/outlet port 174 passing therethrough. The port 174 is positioned within a top panel 176 as shown in FIG. 3. The housing 172 also includes an internal compartment 180 therein. Positioned inside the housing 172 within the compartment 180 is at least one or more flexible bag or bladder-like ink containment vessels which will now be discussed. While multiple, nested ink containment vessels employing a plurality of wall structures may be positioned within the housing 172 as discussed in co-owned Pending U.S. application Ser. No. 08/869,446 to achieve a maximum level of leak resistance, a single-wall vessel structure may also be used. This single-wall vessel system is illustrated in FIGS. 2–3 for the sake of clarity and convenience, with all of the information provided below being equally applicable to both single and multiple vessel devices.

With continued reference to FIGS. 2–3, a bag-like ink containment vessel 182 is provided. The ink containment vessel 182 may involve a single-component, unitary structure or the dual-component unit illustrated in FIGS. 2–3 which consists of two equivalent halves 184, 186 secured together by adhesives or heat-based processes as discussed in co-owned Pending U.S. application Ser. No. 08/869,446. In a preferred embodiment, the halves 184, 186 may involve a single piece of material folded over at the bottom of the vessel 182 so that they engage each other as illustrated in FIG. 2. The selection of either construction design (as well as the use of single or multi-walled vessels) may be undertaken in accordance with preliminary pilot studies involving the particular ink delivery system(s) under consideration. The half 184 of the ink containment vessel 182 includes an outwardly-extending peripheral edge portion 190, with the half 186 likewise including a similar outwardly extending peripheral edge portion 192 (FIG. 2). Both of the edge portions 190, 192 are "flap-like" in character and sized for abutting, conforming engagement with each other as illustrated schematically in FIG. 2. To assemble the multi-part ink containment vessel 182 of FIGS. 2–3, many different methods are possible. For example, a portion of adhesive material (e.g. the compositions discussed below which are used to assemble the film products of the present invention, as well as conventional epoxy and/or cyanoacrylate compounds) may be applied to and between the edge portions 190, 192 in a complete manner around the entire circumference of the ink containment vessel 182 so that the completed vessel 182 is fluid/air tight. Alternatively, the halves 184, 186 of the ink containment vessel 182 can be secured together using standard thermal welding/heat-based processes which are known in the art for assembling polymeric plastic compositions. In situations involving an ink containment vessel 182 (and vessel 150 shown in FIG. 1) of unitary, single-piece construction, these vessels can be produced using known lamination, molding, and other established techniques, with the ink containment vessels and film products of the claimed invention not being restricted to any particular assembly methods.

The ink containment vessel 182 includes an internal cavity 194 therein for storing a supply of ink which is surrounded by a side wall 196 that is produced from the assembled halves 184, 186. The vessel 182 comprises an open first end 200 and a closed second end 202 (FIG. 3). The open first end 200 is secured to the lower section 204 of a tubular member 206 integrally formed in a preferred embodiment within the top panel 176 of the housing 172. The term "tubular" as used herein and throughout this description shall be defined to encompass a structure which includes at least one or more central passageways therethrough that are surrounded by an outer wall. The tubular member 206 incorporates the port 174 therein as shown in FIG. 3. To accomplish attachment of the ink containment vessel 182 to the tubular member 206, the terminal portions 210, 212 of the side wall 196 associated with the ink containment vessel 182 are secured to and sealed in an air-tight manner against the outer surface of the tubular member 206 along the lower section 204 thereof as illustrated in FIG. 3. Attachment may be accomplished using adhesive materials (e.g. the compositions discussed below which are used to assemble the film products of the present invention, as well as conventional epoxy and/or cyanoacrylate compounds). Alternatively, these components can be secured together using standard thermal welding/heat-staking processes which are known in the art for assembling polymer plastic compositions of this nature. As a result of this assembly process and arrangement of components illustrated in FIGS. 2–3, ink materials (e.g. an ink composition 220 as discussed in greater detail below) can flow into or out of the internal cavity 194 of the ink containment vessel 182 via the port 174 passing through the tubular member 206.

Finally, the tubular member 206 positioned within the top panel 176 of the housing 172 includes an upper section 222 which is connected by adhesive materials (e.g. conventional cyanoacrylate or epoxy adhesives), frictional engagement, and the like to a tubular ink transfer conduit 224 positioned within the port 174 shown schematically in FIG. 3. In the embodiment of FIG. 3, the ink transfer conduit 224 includes a first end 226 which is attached using the methods listed above to and within the port 174 in the upper section 222 of the tubular member 206. The ink transfer conduit 224 further includes a second end 230 which is operatively and remotely attached to a printhead 232 which may involve a number of different designs and systems including those which are comparable to the printhead 80 shown in FIG. 1. All of these components are appropriately mounted within the selected printer unit at pre-designated locations therein, depending on the type, size, and overall configuration of the entire ink delivery system. It should also be noted that the ink transfer conduit 224 may include at least one optional in-line pump of conventional design (not shown) for facilitating the transfer of ink.

The systems and materials described above and shown in FIGS. 2–3 are again illustrative in nature. They shall not be considered limiting or restrictive in connection with the present invention and its various embodiments. Instead, the embodiment of FIGS. 2–3 may be varied as needed and is presented entirely to demonstrate the applicability of the claimed film products and ink containment vessels to ink delivery systems which employ a remotely located ink storage unit.

Many different supplies and types of ink may be used as the ink composition 32 (FIG. 1) and ink composition 220 (FIG. 3) in the ink delivery systems discussed above and in others associated with the present invention. Likewise, the term "ink" as used herein shall encompass dye-based materials, pigment dispersions, and liquid-toner products. However, the claimed invention is especially suitable for use with ink materials that contain volatile components (e.g. organic solvents and water), as well as materials which are corrosive in nature relative to traditional organic polymer compounds (e.g. acidic dyes and organic solvents). The term "corrosive" shall again encompass situations in which the ink materials of interest are capable of chemically degrading the ink containment vessels in which they are contained. Corrosive agents in the ink formulations may include one or more of the organic solvents which are used, as well as various acidic coloring agents and other materials (depending on the ink products under consideration.) Some representative and non-limiting ink formulations will now be discussed in detail which again may be employed in connection with the ink compositions 32, 220 discussed above.

The ink compositions of interest will first contain at least one coloring agent. Again, the present invention shall not be restricted to any particular coloring agents or mixtures thereof. While many different materials may be encompassed within the term "coloring agent" as previously noted, this discussion will focus on dye products which can involve a wide variety of colors (including black). Exemplary dye materials (which are black in color) that are suitable for use in the ink compositions are listed in U.S. Pat. No. 4,963,189 to Hindagolla which is incorporated herein by reference. Additional dye materials of interest are described in the *Color Index,* Vol. 4, 3rd ed., published by The Society of Dyers and Colourists, Yorkshire, England (1971) which is incorporated herein by reference and is a standard text that is well known in the art. Exemplary dye materials listed in the *Color Index,* supra, that are suitable for use herein include but are not limited to the following compositions: C.I. Direct Yellow 11, C.I. Direct Yellow 86, C.I. Direct Yellow 132, C.I. Direct Yellow 142, C.I. Direct Red 9, C.I. Direct Red 24, C.I. Direct Red 227, C.I. Direct Red 239, C.I. Direct Blue 9, C.I. Direct Blue 86, C.I. Direct Blue 189, C.I. Direct Blue 199, C.I. Direct Black 19, C.I. Direct Black 22, C.I. Direct Black 51, C.I. Direct Black 163, C.I. Direct Black 169, C.I. Acid Yellow 3, C.I. Acid Yellow 17, C.I. Acid Yellow 23, C.I. Acid Yellow 73, C.I. Acid Red 18, C.I. Acid Red 33, C.I. Acid Red 52, C.I. Acid Red 289, C.I. Acid Blue 9, C.I. Acid Blue 61: 1, C.I. Acid Blue 72, C.I. Acid Black 1, C.I. Acid Black 2, C.I. Acid Black 194, C.I. Reactive Yellow 58, C.I. Reactive Yellow 162, C.I. Reactive Yellow 163, C.I. Reactive Red 21, C.I. Reactive Red 159, C.I. Reactive Red 180, C.I. Reactive Blue 79, C.I. Reactive Blue 216, C.I. Reactive Blue 227, C.I. Reactive Black 5, C.I. Reactive Black 31, C.I. Basic Yellow 13, C.I. Basic Yellow 60, C.I. Basic Yellow 82, C.I. Basic Blue 124, C.I. Basic Blue 140, C.I. Basic Blue 154, C.I. Basic Red 14, C.I. Basic Red 46, C.I. Basic Red 51, C.I. Basic Black 11, and mixtures thereof. These materials are known in the art and commercially available from a variety of sources. Exemplary sources for dye materials of the type described above include but are not limited to the Sandoz Corporation of East Hanover, N.J. (USA), Ciba-Geigy of Ardsley, N.Y. (USA), and others.

As previously noted, the term "coloring agent" shall encompass pigment dispersions known in the art which basically involve a water-insoluble colorant (e.g. a pigment) which is rendered soluble through association with a dispersant (e.g. an acrylic dispersant). Specific pigments which may be employed to produce pigment dispersion materials are known in the art, and the present invention shall not be limited to any particular chemical compositions in this regard. Examples of such pigments include the following compositions which are listed in the *Color Index,* supra: C.I. Pigment Black 7, C.I. Pigment Blue 15, and C.I. Pigment Red 2. Dispersant materials suitable for combination with the foregoing pigments will include monomers and polymers known in the art. An exemplary commercial dispersant involves a product sold by W.R. Grace and Co. of Lexington, Mass. (USA) under the trademark DAXAD. In a preferred embodiment, the ink compositions of interest will contain about 2–7% by weight total coloring agent therein (e.g. whether a single coloring agent or combined coloring agents are used). However, the amount of coloring agent to be employed may be varied as need, depending on the ultimate purpose for which the ink composition is intended and the other ingredients in the ink.

The ink composition will also include an ink "vehicle" which essentially functions as a carrier medium and main solvent for the other components in the composition. Many different materials may be used as the ink vehicle, with the present invention not being limited to any particular products for this purpose. A preferred ink vehicle will consist of water combined with other ingredients including organic solvents. These organic solvents include but are not limited to 2-pyrrolidone, 1,5-pentanediol, N-methyl pyrrolidone, 2-propanol, 2-ethyl-2-hydroxymethyl-1,3-propanediol, and cyclohexanol. Such materials are volatile in character and can be lost by evaporation. If this situation occurs, the ink compositions of interest can experience changes in viscosity, homogeneity, and color character which will typically result in a substantial deterioration in print quality. All of these materials may be used in various combinations as determined by preliminary pilot studies on the ink compositions of concern. However, in a preferred embodiment, the ink compositions will contain about 70–80% by weight total combined ink vehicle, wherein at least about 30% by weight of the total ink vehicle will typically consist of water (with the balance comprising any one of the above-listed organic solvents alone or combined). An exemplary ink vehicle will contain about 60–80% by weight water and about 10–30% by weight of one or more organic solvents.

The ink compositions may also include a number of optional ingredients in varying amounts. For example, an optional biocide may be added to prevent any microbial growth in the final ink product. Exemplary biocides suitable for this purpose include proprietary products sold under the trademarks PROXEL GXL by Imperial Chemical Industries of Manchester, England; UCARCID by Union Carbide of Danbury, Conn. (USA); and NUOSEPT by Huls America, Inc. of Piscataway, N.J. (USA). In a preferred embodiment, if a biocide is used, the final ink composition will typically include about 0.05–0.5% by weight biocide, with about 0.30% by weight being preferred.

Another optional ingredient to be used in the ink compositions will involve one or more buffering agents. The use of a selected buffering agent or multiple (combined) buffering agents is designed to stabilize the pH of the ink compositions. In a preferred embodiment, the desired pH of the ink compositions will range from about 4–9. Exemplary buffering agents suitable for this purpose will comprise sodium borate, boric acid, and phosphate buffering materials known in the art for pH control. The selection of any particular buffering agents and the amount of buffering agents to be used (as well as the decision to use buffering agents in general) will be determined in accordance with preliminary pilot studies on the particular ink compositions of concern. Additional ingredients (e.g. surfactants) may also be present in the ink compositions if needed in accordance with the intended use thereof.

Use of the unique film products and ink containment vessels produced therefrom shall not be restricted to the ink compositions listed above which are provided for example purposes only. Many other ink materials may be employed including those recited in U.S. Pat. No. 5,185,034 which is incorporated herein by reference.

B. The Ink-Resistant Film Products and Ink Containment Vessels Produced Therefrom The film products of the present invention shall generally involve a plurality of material layers which are laminated together to form a single structural unit which effectively prevents air and volatile ink components (e.g. organic solvents and water) from passing therethrough. The plurality of material layers (in its broadest sense) includes (1) at least one layer constructed from an organic polymer composition, with the term "polymer" being defined in a conventional manner to again involve a carbon-containing molecule which includes a plurality of repeating structural units; and (2) at least one layer of elemental silver [Ag]. The layer of silver contributes to the unique features of the completed film product including its corrosion resistance and ability to prevent the passage of gaseous materials therethrough.

It is again important to emphasize that the claimed invention shall not be limited to any number, order, or arrangement of material layers within the completed film products. A wide variety of different layering arrangements and compositions will work effectively for the purposes outlined herein provided that the final products include the two basic components listed above. Any listing of particular construction materials, layering arrangements, or layer numbers relative to the completed film products and ink containment vessels is provided for example purposes only and shall not restrict the invention in any manner.

While the film products of interest will necessarily encompass a wide variety of different laminate structures, optimum results are achieved if the metallic layer of elemental silver is combined (in varying arrangements and layer-orders) with three (3) particular and preferred types of organic polymer compositions. Accordingly, the completed film products (and side walls of the ink containment vessels) will optimally include the following components/layers which are discussed in the following "definition" section:

1. At least one "structural support layer" which shall be defined to involve a layer (and components used therein) which provide mechanical strength and tear-resistance to the completed film-products and ink containment vessels. Representative and non-limiting organic polymers which may be employed for this purpose (which are specifically designated herein as "organic polymer reinforcement compositions") include but are not limited to polyester, nylon, polypropylene, polyethylene, and mixtures thereof. A preferred thickness value associated with the structural support layer in all embodiments of the invention involves, without limitation, about 0.00025–0.001 inches (optimum=about 0.0004–0.0007 inches).

2. At least one "sealant layer" which is optimally used as the innermost, ink-contacting layer in the completed ink containment vessel that is secured by "sealing" to the surrounding components of the ink delivery system. The sealant layer is constructed from at least one "organic polymer sealant composition" which is chemically capable of being attached by conventional "heat-staking" methods (defined below) or other thermal attachment processes (as well as adhesive affixation techniques) to itself or to various plastic parts in the ink delivery system of interest. In this manner, an ink containment vessel is formed which is "sealed" in character. Representative and non-limiting examples of materials which are encompassed within the term "organic polymer sealant composition" include but are not limited to polyethylene vinyl acetate, polyethylene, polypropylene, and mixtures thereof. To provide best results, these materials (and other suitable compositions) should have a melting temperature of about 120–200° C., although the invention shall not be restricted to materials which melt within this range. A preferred thickness value associated with the sealant layer in all embodiments of the invention involves, without limitation, about 0.0004–0.004 inches (optimum=about 0.0005–0.002 inches).

3. A "barrier layer" constructed of at least one "bi-axially oriented organic polymer barrier composition", with this layer being used to provide enhanced resistance to the passage of both liquid and gaseous materials therethrough (including air and volatile ink components). Likewise, the barrier layer is optimally used as a bonding surface for application of the metallic layer comprised of elemental silver thereto. Bonding of the metallic layer to the barrier layer is facilitated by the bi-axial character of the materials used to construct the barrier layer. In particular, the "bi-axially oriented organic polymer barrier composition" used to form the barrier layer shall involve organic polymer compounds which are sufficiently smooth and compatible with the metallic layer to allow the direct deposition of silver on the barrier layer using, for example, standard high-voltage sputtering deposition or vapor deposition technology. The term "bi-axially oriented" as used herein shall involve a structural configuration in which molecules within the bi-axial compositions of interest travel in different directions (both lengthwise and crosswise) compared with linear structures that incorporate molecules which are all aligned in one direction. The formation of bi-axial structures during production of the desired polymeric materials (which involves the precise control of molecular orientations within the compositions) provides improved strength and stability, as well as reduced elasticity. Likewise, the use of "bi-axially oriented" materials in this particular layer is desired because they will substantially prevent the cracking and loss of barrier properties associated with metallic layers applied thereto which may occur if non-bi-axially oriented materials are employed. Representative and non-limiting examples of "bi-axially oriented organic polymer barrier materials" which may be used in the claimed film products and ink containment vessels produced therefrom include but are not limited to bi-axially oriented polypropylene, bi-axially oriented nylon, bi-axially oriented polyester, and mixtures thereof which are commercially-available products. A preferred thickness value associated with the barrier layer in all embodiments of the invention involves, without limitation, about 0.00025–0.001 inches (optimum=about 0.0004–0.0007 inches).

The metallic layer comprised of elemental silver (which is optimally applied in a direct manner without the use of adhesive materials to the top and/or bottom surfaces of the barrier layer) has a preferred and non-limiting thickness value of about 0.02–0.10 micrometers (optimum=about 0.03–0.07 micrometers). Furthermore, the term "comprised of silver" may involve a layer which is (1) made entirely of elemental silver without other metals or materials combined therewith (preferred); and (2) made of a combination of elemental silver and one or more other metals in a mixture, amalagam, or alloy including but not limited to at least one of the noble metals listed above (particularly gold). Such mixtures (for practical and economic reasons) should include at least about 50% or more by weight elemental silver although this value may be varied as needed. It should also be noted that certain additional layers may be employed within the plurality of material layers used to produce the claimed film products. These additional layers (which are optional and used in accordance with routine preliminary pilot testing involving the particular ink containment vessels and ink materials of interest) include the following items:

A. At least one "protective layer" produced from a selected "hydrophobic composition". The protective layer is designed for placement within the selected film products to enhance the corrosion resistance of the metallic layer of elemental silver (and to avoid the formation of yellow-colored "corrosion spots" thereon). The term "hydrophobic" as used herein shall involve a composition which does not absorb or transmit water therethrough. Representative and non-limiting materials which may be employed as "hydrophobic compositions" within the protective layer include but are not limited to polyurethane, perfluoroated polyacrylate compounds, epoxy polymers, silane coupling agents, silicone polymers, and mixtures thereof. Exemplary perfluoroated polyacrylate compositions include $CF_3(CF_2)$, $OCOCHCH_2$ (n=2–18); and $CF_3(CF_2)$,$OCOCCH_3CH_2$ (n=2–18). Representative silane coupling agents comprise (3,3,3-trifluoropropyl) methyldichlorosilane, (3,3,3-trifluoropropyl) methyldimethoxysilane, and N-(3-trimethoxysilylpropyl) pyrrole. While many different methods may be employed to apply selected hydrophobic composition in a desired position within the claimed film products, is it preferred that application be accomplished by standard lamination or co-extrusion methods.

A preferred thickness value associated with the protective layer in all embodiments of the invention involves, without limitation, about 0.00025–0.001 inches (optimum=about 0.0004–0.0007 inches). The protective layer of the selected "hydrophobic composition" shall optimally be positioned on top of (e.g. over) the surface of the metallic layer comprised of elemental silver in order to protect it from corrosion as discussed further below. However, the invention shall not be restricted to the placement of this particular layer in any location or orientation within the completed film products and ink containment vessels.

B. At least one "metal-containing corrosion-control layer" constructed from one or more elemental noble metals. The term "noble metal" shall be defined in a conventional manner and will involve the following elemental metals alone or in combination: Gold [Au], Platinum [Pt], Mercury [Hg], Palladium [Pd], Iridium [Ir], Rhodium [Rh], Ruthenium [Ru], and Osmium [Os] with gold and platinum being best. An optimum thickness value associated with the corrosion-control layer in all embodiments of the invention involves, without limitation, about 0.02–0.10 micrometers (optimum=about 0.03–0.07 micrometers). The corrosion control layer produced from the selected noble metal(s) shall optimally be positioned on top of (e.g. over) the surface of the metallic layer comprised of elemental silver in order to protect it from corrosion as discussed below. The metal-containing corrosion-control layer can be used instead of or in addition to the protective layer of hydrophobic material. However, the present invention shall not be restricted to the placement of this particular layer in any location or orientation within the completed film products and ink containment vessels. It should also be noted that the metal-containing corrosion-control layer is optimally applied to the desired surface(s) within the claimed film products using conventional metal delivery processes including standard high-voltage sputtering deposition or vapor deposition techniques.

As previously noted, the present invention shall not be restricted to any number, arrangement, sequence, or order of material layers, as well as the specific compositions associated with these layers unless otherwise noted herein. Many different combinations of materials and layer-orders are possible provided that the completed film products (and the side walls of the selected ink containment vessels) include one or more organic polymer layers and one or more layers containing elemental silver therein. Regarding attachment of the material layers together to yield a composite, laminate film product, many different conventional assembly methods are possible. For example, as previously discussed, initial delivery of the metal-containing layers (e.g. the metallic layer comprised of elemental silver and [if used] the metal-containing corrosion-control layer produced from at least one elemental noble metal) is typically accomplished using standard high-voltage sputtering deposition or vapor deposition techniques. In the alternative, metal foils can be applied using the conventional adhesive materials listed below in connection with attachment of the organic polymer layers together.

Regarding the various organic polymer layers in the film products, these layers are typically adhered together (and to the metal-containing layers listed above) using a layer of a selected adhesive composition. The adhesive composition is preferably applied to and between the particular layers which are to be attached together. This invention shall also not be restricted to any particular chemical adhesive compositions for this purpose. Representative (non-limiting) adhesives which may be employed include but are not limited to polyurethane and/or epoxy based adhesives (with or without optional "promoting agents" such as silane coupling compositions of the type listed above in connection with the hydrophobic materials). Some specific adhesive materials which may be used in the adhesive layers described herein include known polyurethane, epoxy, polyester, and polyacrylic-based adhesives which are commercially-available from numerous sources including Bostic of Middletown, Mass. (USA) and the Liofol Company of Cary, N.C. (USA). Each layer of adhesive material is preferably applied at a non-limiting, exemplary thickness range of about 0.00004–0.0004 inches (optimum=about 0.0001–0.0002 inches) using conventional adhesive application technology (roll-coating devices and the like).

While the film products and ink containment vessels described herein shall not be restricted to any particular arrangement or quantity of material layers as previously noted, a number of preferred embodiments are provided herein for example purposes (See FIGS. 4–9). These embodiments are as follows (with all of the various layer definitions, representative layer materials/compositions, and attachment methods described above being entirely applicable and incorporated by reference relative thereto):

EXAMPLE 1

Figure 4:
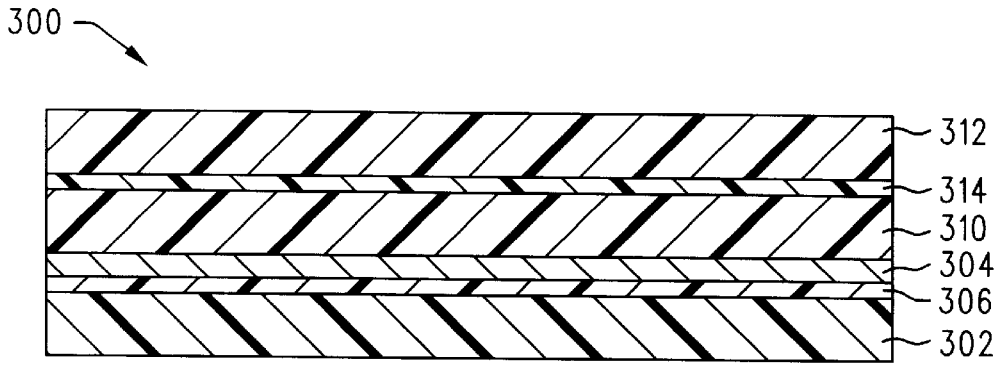
FIG. 4 is an enlarged, schematically-illustrated cross-sectional view of a multi-layer film product which may be employed to produce the ink containment vessels described below.

In this example, a film product 300 is disclosed and illustrated cross-sectionally in FIG. 4 which includes a structural support layer 302 comprised of an organic polymer reinforcement composition as defined above. It is important to note that, in this Example (and the other Examples which follow), the various material layers are enlarged for the sake of clarity and not necessarily drawn to scale or in actual proportion to each other. Thus, the materials shown in the following Examples are representative and schematic only. The structural support layer 302 is optimally employed as the outermost layer of material in the film product 300 which is typically in contact with the external environment (and not in communication with any ink compositions) when the film product 300 is used in a selected ink containment vessel (e.g. vessels 150, 182). Positioned over the structural support layer 302 and secured thereto is a metallic layer 304 comprised of elemental silver [Ag]. The metallic layer 304 is optimally adhered to the underlying structural support layer 302 using a primary adhesive layer 306 positioned therebetween which is comprised of one or more of the adhesive compositions listed above in the definition section.

Next, positioned over and secured to the metallic layer 304 of elemental silver is a barrier layer 310 comprised of a bi-axially oriented organic polymer barrier composition. During fabrication of the film product 300 shown in FIG. 4, the metallic layer 304 of elemental silver is optimally applied to the barrier layer 310 using conventional metal delivery methods as previously discussed including standard high-voltage sputter deposition or vapor deposition techniques. The smooth surfaces of the barrier layer 310 which result from its bi-axial character greatly facilitate this deposition process and a strong degree of adhesion between the metallic layer 304 and the overlying barrier layer 310.

Finally, positioned over and secured to the barrier layer 310 is a sealant layer 312 comprised of an organic polymer sealant composition (discussed above). The sealant layer 312 and barrier layer 310 are secured together using a secondary adhesive layer 314 positioned therebetween which is optimally comprised of the same adhesive compositions listed above and employed within the primary adhesive layer 306. The sealant layer 312, in a preferred embodiment, functions as the innermost layer which is exposed to ink materials when the film product 300 is used in a selected ink containment vessel (e.g. vessels 150, 182). Likewise, in accordance with the specific chemical characteristics of the sealant layer 312 as previously discussed, it is readily attachable to surrounding plastic components of common chemical origin within the ink delivery system under consideration using conventional adhesives (including those listed above, as well as standard epoxy resin and cyanoacrylate adhesives). Alternatively, the sealant layer may be secured in position using known thermal attachment processes which employ traditional "heat-staking" technology. Heat-staking basically involves the use of heated bars or shaped surfaces that simultaneously hold the components of interest together while transferring heat sufficient to melt and bond the components together.

As shown in FIG. 4, this particular embodiment involves a layering arrangement wherein the barrier layer 310 is positioned between the sealant layer 312 and the metallic layer 304 comprised of elemental silver, with the metallic layer 304 being positioned between the barrier layer 310 and the structural support layer 302.

EXAMPLE 2

Figure 5:
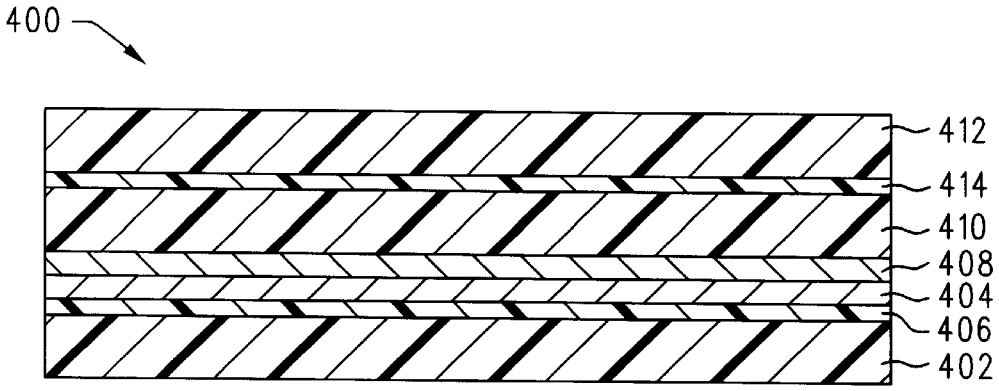
FIG. 5 is an enlarged, schematically-illustrated cross-sectional view of an alternative multi-layer film product which may be used produce the ink containment vessels described below.

A film product 400 is disclosed and illustrated cross-sectionally in FIG. 5 which includes a structural support layer 402 comprised of an organic polymer reinforcement composition as defined above in the definition section. The structural support layer 402 is again optimally employed as the outermost layer of material in the film product 400 which is typically in contact with the external environment (and not in communication with any ink compositions) when the film product 400 is used in a selected ink containment vessel (e.g. vessels 150, 182).

Positioned over and secured to the structural support layer 402 is a metallic layer 404 comprised of elemental silver. The metallic layer 404 is optimally adhered to the underlying structural support layer 402 using a primary adhesive layer 406 positioned therebetween which is comprised of one or more of the adhesive compositions previously discussed.

Next, positioned over and secured to the metallic layer 404 comprised of elemental silver is a corrosion-control layer 408 comprised of at least one or more elemental noble metals as defined above (optimally elemental gold [Au]). In turn, a barrier layer 410 is positioned over and secured to the corrosion-control layer 408. The barrier layer 410 is comprised of a bi-axially oriented organic polymer barrier composition (discussed above in the definition section). During fabrication of the film product 400 shown in FIG. 5, the noble metal-containing corrosion-control layer 408 may be initially applied by conventional metal delivery processes (including standard high-voltage sputter deposition or vapor deposition techniques) to the barrier layer 410. The smooth surfaces of the barrier layer 410 which result from its bi-axial character greatly facilitate this deposition process and a strong degree of adhesion between the noble metal-containing corrosion-control layer 408 and the overlying barrier layer 410. After this deposition process is completed, the metallic layer 404 comprised of elemental silver may be applied using conventional metal delivery processes (again including standard high-voltage sputter deposition or vapor deposition techniques) to the corrosion-control layer 408. This "step-wise" production method enables these intermediate layers of material to be assembled in a rapid and structurally-sound manner.

Finally, positioned over and secured to the barrier layer 410 is a sealant layer 412 comprised of an organic polymer sealant composition (discussed above). The sealant layer 412 and barrier layer 410 are attached together using a secondary adhesive layer 414 positioned therebetween which is optimally comprised of the same adhesive compositions listed above and employed within the primary adhesive layer 406. The sealant layer 412 preferably functions as the innermost layer which is exposed to ink materials when the film product 400 is used in a selected ink containment vessel (e.g. vessels 150, 182). Likewise, in accordance with the specific chemical characteristics of the sealant layer 412 as previously discussed, it is readily attachable to surrounding plastic components of common chemical origin within the ink delivery system under consideration using conventional adhesives (including those listed above, as well as standard epoxy resin and cyanoacrylate adhesives). Alternatively, the sealant layer 412 may be secured in position using known thermal attachment processes which employ traditional heat-staking technology.

It should be noted that the film product 400 (FIG. 5) and the film product 300 (FIG. 4) are substantially the same except for addition of the corrosion-control layer 408 between the barrier layer 410 and the metallic layer 404 comprised of elemental silver. Use of the corrosion-control layer 408 shall occur in accordance with preliminary pilot testing involving the particular ink delivery systems and ink compositions under consideration.

With reference to FIG. 5, this particular embodiment involves a layering arrangement wherein the barrier layer 410 is positioned between the sealant layer 412 and the metallic layer 404 comprised of elemental silver, with the metallic layer 404 being positioned between the barrier layer 410 and the structural support layer 402. Regarding the corrosion-control layer 408, it is positioned between the barrier layer 410 and the metallic layer 404 comprised of elemental silver.

EXAMPLE 3

Figure 6:
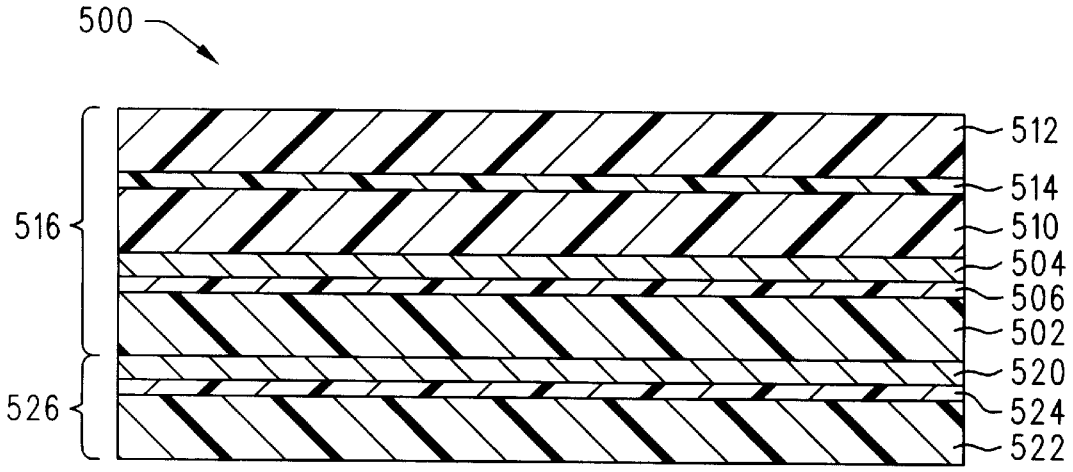
FIG. 6 is an enlarged, schematically-illustrated cross-sectional view of a further alternative multi-layer film product which may be used produce the ink containment vessels described below.

In this example, a film product 500 is disclosed and illustrated cross-sectionally in FIG. 6 which includes a structural support layer 502 comprised of an organic polymer reinforcement composition as defined above. Positioned over the structural support layer 502 and secured thereto is a metallic layer 504 comprised of elemental silver. The metallic layer 504 is optimally adhered to the underlying structural support layer 502 using a primary adhesive layer 506 positioned therebetween which is comprised of one or more of the adhesive compositions listed above.

Next, positioned over and secured to the metallic layer 504 comprised of elemental silver is a barrier layer 510 comprised of a bi-axially oriented organic polymer barrier composition (discussed and defined above in the definition section). During fabrication of the film product 500 shown in FIG. 6, the metallic layer 504 comprised of elemental silver is optimally applied to the barrier layer 510 using conventional metal delivery methods as previously discussed including standard high-voltage sputter deposition or vapor deposition techniques. The smooth surfaces of the barrier layer 510 which result from its bi-axial character greatly facilitate this deposition process and a strong degree of adhesion between the metallic layer 504 and the overlying barrier layer 510.

Finally, positioned over and secured to the barrier layer 510 is a sealant layer 512 comprised of an organic polymer sealant composition (discussed above). The sealant layer 512 and barrier layer 510 are secured together using a secondary adhesive layer 514 positioned therebetween which is optimally comprised of the same adhesive compositions listed above and employed within the primary adhesive layer 506. The sealant layer 512 preferably functions as the innermost layer which is exposed to ink materials when the film product 500 is used in a selected ink containment vessel (e.g. vessels 150, 182). Likewise, in accordance with the specific chemical characteristics of the sealant layer 512 as previously discussed, it is readily attachable to surrounding plastic components of common chemical origin within the ink delivery system under consideration using conventional adhesives (including those listed above, as well as standard epoxy resin and cyanoacrylate adhesives). Alternatively, the sealant layer 512 may be secured in position using known thermal attachment processes which employ traditional heat-staking technology.

At this stage, the film product discussed above (which is designated in FIG. 6 at reference number 516 and characterized as a "base structure") is substantially identical with the film product 300 shown in FIG. 4. However, to provide an added degree of corrosion resistance and overall durability, various supplemental layers of material are added to the base structure 516. With continued reference to FIG. 6, a supplemental metal-containing layer 520 constructed partially or entirely of elemental silver is provided which is substantially identical to the main metallic layer 504 comprised of elemental silver in thickness, content, and the other parameters discussed above. The supplemental metal-containing layer 520 is positioned below and may be secured to the structural support layer 502 using an intermediate layer of adhesive material (not shown) therebetween (e.g. of the same type described above in connection with the primary adhesive layer 506). However, it is preferred that the supplemental metal-containing layer 520 be applied to the overlying structural support layer 502 during fabrication of the film product 500 using conventional metal delivery methods as previously discussed including standard high-voltage sputter deposition or vapor deposition techniques.

Next, a supplemental sealant-containing layer 522 comprised of an organic polymer sealant composition is positioned below and secured to the supplemental metal-containing layer 520. The supplemental sealant-containing layer 522 will optimally have the same thickness value and organic polymers therein as indicated above in connection with the main sealant layer 512. The supplemental sealant-containing layer 522 and supplemental metal-containing layer 520 are preferably secured together using a tertiary adhesive layer 524 positioned therebetween which is comprised of the same adhesive compositions previously listed and employed within the primary adhesive layer 506. As shown in FIG. 6, the combined supplemental metal-containing layer 520 and supplemental sealant-containing layer 522 (with the tertiary adhesive layer 524 therebetween) will form a "supplemental structure" designated at reference number 526. The base structure 516 positioned over and secured to the supplemental structure 526 forms the completed film product 500.

In the film product 500, the supplemental sealant-containing layer 522 is optimally employed as the outermost layer of material in the film product 500 which is typically in contact with the external environment (and not in communication with any ink compositions) when the film product 500 is used in a selected ink containment vessel (e.g. vessels 150, 182). Likewise, the main sealant layer 512 preferably functions as the innermost layer which is exposed to ink materials when the film product 500 is used in the ink containment vessels of interest. In accordance with the specific chemical characteristics of the main sealant layer 512 as previously discussed, it is readily attachable to surrounding plastic components of common chemical origin within the ink delivery system under consideration using conventional adhesives (including those listed above, as well as standard epoxy resin and cyanoacrylate adhesives). Alternatively, the sealant layer 512 may be secured in position using known thermal attachment processes which employ traditional heat-staking technology. The need for incorporation of the "enhanced" film product 500 in a particular ink containment vessel shall be determined in accordance with preliminary pilot studies involving the ink delivery systems and ink compositions under consideration.

With respect to this particular embodiment, a layering arrangement is provided wherein the barrier layer 5 10 is positioned between the sealant layer 512 and the metallic layer 504 comprised of elemental silver, with the metallic layer 504 being positioned between the barrier layer 510 and the structural support layer 502 as shown in FIG. 6. Furthermore, the structural support layer 502 is positioned between the metallic layer 504 comprised of elemental silver and the supplemental metal-containing layer 520, with the supplemental metal-containing layer 520 being positioned between the structural support layer 502 and the supplemental sealant-containing layer 522 (as again illustrated in FIG. 6.).

EXAMPLE 4

Figure 7:
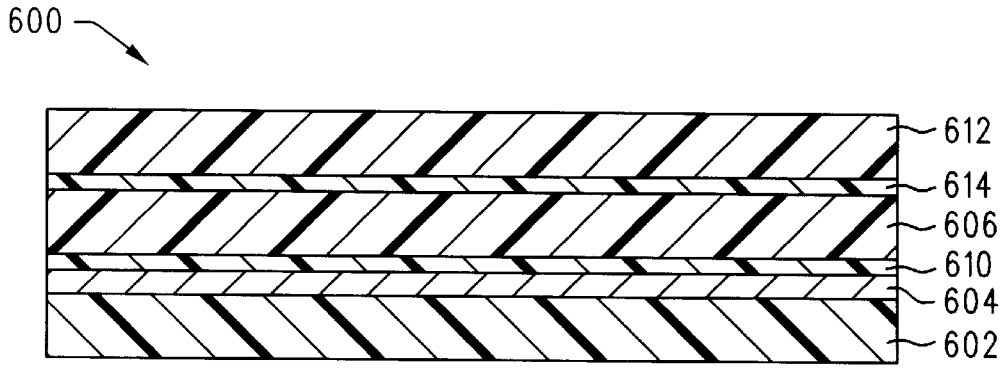
FIG. 7 is an enlarged, schematically-illustrated cross sectional view of a still further alternative multi-layer film product which may be used produce the ink containment vessels described below.

A film product 600 is disclosed and illustrated cross-sectionally in FIG. 7 which includes a barrier layer 602 comprised of a bi-axially oriented organic polymer barrier composition as defined above. The barrier layer 602 is optimally employed as the outermost layer of material in the film product 600 which is typically in contact with the external environment (and not in communication with any ink compositions) when the film product 600 is used in a selected ink containment vessel (e.g. vessels 150, 182).

Positioned over and secured to the barrier layer 602 is a metallic layer 604 comprised of elemental silver. The metallic layer 604 is optimally adhered to the underlying barrier layer 602 using conventional metal delivery methods as outlined above including standard high-voltage sputter deposition or vapor deposition techniques. The smooth surfaces of the barrier layer 602 which result from its bi-axial character greatly facilitate this deposition process and a strong degree of adhesion between the metallic layer 604 and the underlying barrier layer 602.

Positioned over and secured to the metallic layer 604 comprised of elemental silver is a structural support layer 606 comprised of an organic polymer reinforcement composition (discussed above). The structural support layer 606 and the metallic layer 604 are preferably secured together using a primary adhesive layer 610 positioned therebetween which is comprised of one or more of the adhesive compositions listed above.

Finally, positioned over and secured to the structural support layer 606 is a sealant layer 612 comprised of an organic polymer sealant composition. The sealant layer 612 and structural support layer 606 are secured together using a secondary adhesive layer 614 positioned therebetween which is comprised of the same adhesive compositions listed above and employed within the primary adhesive layer 610. The sealant layer 612 preferably functions as the innermost layer which is exposed to ink materials when the film product 600 is used in a selected ink containment vessel (e.g. vessels 150, 182). Likewise, in accordance with the specific chemical characteristics of the sealant layer 612 as previously discussed, it is readily attachable to surrounding plastic components of common chemical origin within the ink delivery system under consideration using conventional adhesives (including those listed above, as well as standard epoxy resin and cyanoacrylate adhesives). Alternatively, the sealant layer 612 may be secured in position using known thermal attachment processes which employ traditional heat-staking technology.

As shown in FIG. 7, this particular embodiment involves a layering arrangement wherein the structural support layer 606 is positioned between the sealant layer 612 and the metallic layer 604 comprised of elemental silver, with the metallic layer 604 being positioned between the structural support layer 606 and the barrier layer 602.

EXAMPLE 5

Figure 8:
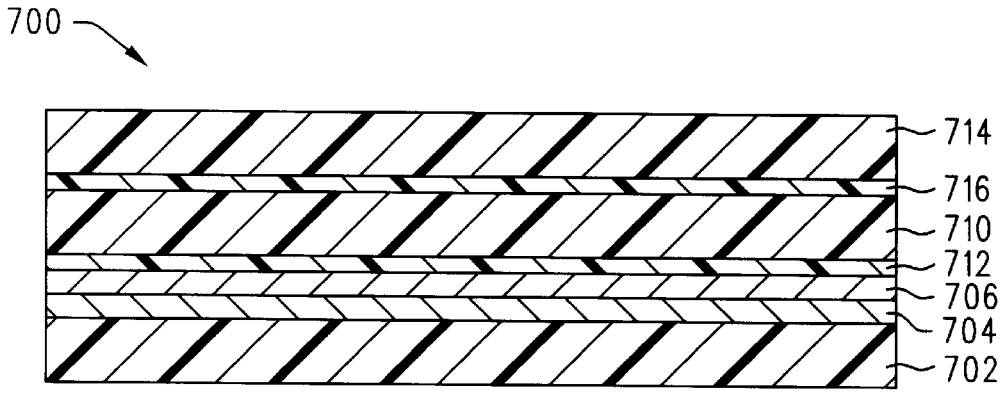
FIG. 8 is an enlarged, schematically-illustrated cross sectional view of a still further alternative multi-layer film product which may be used produce the ink containment vessels described below.

A film product 700 is disclosed and illustrated cross-sectionally in FIG. 8 which includes a barrier layer 702 comprised of a bi-axially oriented organic polymer barrier composition as defined above. The barrier layer 702 is optimally employed as the outermost layer of material in the film product 700 which is typically in contact with the external environment (and not in communication with any ink compositions) when the film product 700 is used in a selected ink containment vessel (e.g. vessels 150, 182).

Positioned over and secured to the barrier layer 702 is a metallic layer 704 comprised of elemental silver. The metallic layer 704 is optimally adhered to the underlying barrier layer 702 using conventional metal delivery methods as outlined above including standard high-voltage sputter deposition or vapor deposition techniques. The smooth surfaces of the barrier layer 702 which result from its bi-axial character greatly facilitate this deposition process and a strong degree of adhesion between the metallic layer 704 and the underlying barrier layer 702.

Next, positioned over and secured to the metallic layer 704 comprised of elemental silver is a corrosion-control layer 706 comprised of at least one or more elemental noble metals as defined above (optimally elemental gold). During fabrication of the film product 700 shown in FIG. 8, the noble metal-containing corrosion-control layer 706 is optimally applied by conventional metal delivery processes (including standard high-voltage sputter deposition or vapor deposition techniques) to the underlying metallic layer 704 comprised of elemental silver. This "step-wise" production method which involves the attachment of multiple metal layers to each other using sputter deposition or vapor deposition technology enables these intermediate layers of material to be assembled in a rapid and structurally-sound manner.

Positioned over and secured to the noble metal-containing corrosion-control layer 706 is a structural support layer 710 comprised of an organic polymer reinforcement composition. The structural support layer 710 and the noble metal-containing corrosion-control layer 706 are preferably secured together using a primary adhesive layer 712 positioned therebetween which is comprised of one or more of the adhesive compositions listed above.

Finally, positioned over and secured to the structural support layer 710 is a sealant layer 714 comprised of an organic polymer sealant composition. The sealant layer 714 and structural support layer 710 are attached together using a secondary adhesive layer 716 positioned therebetween which is comprised of the same adhesive compositions listed above and employed within the primary adhesive layer 712. The sealant layer 714 preferably functions as the innermost layer which is exposed to ink materials when the film product 700 is used in a selected ink containment vessel (e.g. vessels 150, 182). Likewise, in accordance with the specific chemical characteristics of the sealant layer 714 as previously discussed, it is readily attachable to surrounding plastic components of common chemical origin within the ink delivery system under consideration using conventional adhesives (including those listed above, as well as standard epoxy resin and cyanoacrylate adhesives). Alternatively, the sealant layer 714 may be secured in position using known thermal attachment processes which employ traditional heat-staking technology.

It should be noted that the film product 700 (FIG. 8) and the film product 600 (FIG. 7) are substantially the same except for addition of the corrosion-control layer 706 between the barrier layer 710 and the metallic layer 704 comprised of elemental silver. Use of the corrosion-control layer 706 shall occur in accordance with preliminary pilot testing involving the particular ink delivery systems and ink compositions under consideration.

As shown in FIG. 8, this particular embodiment involves a layering arrangement wherein the structural support layer 710 is positioned between the sealant layer 714 and the metallic layer 704 comprised of elemental silver, with the metallic layer 704 being positioned between the structural support layer 710 and the barrier layer 702. Furthermore, the noble metal-containing corrosion-control layer 706 is positioned between the structural support layer 710 and the metallic layer 704 comprised of elemental silver (FIG. 8).

EXAMPLE 6

Figure 9:
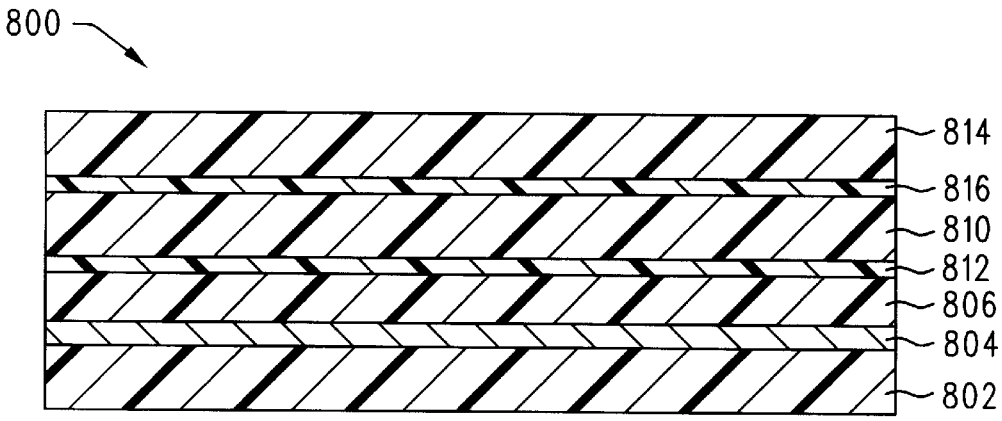
FIG. 9 is an enlarged, schematically-illustrated cross sectional view of an even further alternative multi-layer film product which may be used produce the ink containment vessels described below.

A film product 800 is disclosed and illustrated cross-sectionally in FIG. 9 which includes a barrier layer 802 comprised of a bi-axially oriented organic polymer barrier composition as defined above. The barrier layer 802 is optimally employed as the outermost layer of material in the film product 800 which is typically in contact with the external environment (and not in communication with any ink compositions) when the film product 800 is used in a selected ink containment vessel (e.g. vessels 150, 182).

Positioned over and secured to the barrier layer 802 is a metallic layer 804 comprised of elemental silver. The metallic layer 804 is optimally adhered to the underlying barrier layer 802 using conventional metal delivery methods as outlined above including standard high-voltage sputter deposition or vapor deposition techniques. The smooth surfaces of the barrier layer 802 which result from its bi-axial character greatly facilitate this deposition process and a strong degree of adhesion between the metallic layer 804 comprised of elemental silver and the underlying barrier layer 802.

Next, positioned over and secured to the metallic layer 804 comprised of elemental silver is a protective layer 806 comprised of at least one or more hydrophobic compositions which are applied as defined above. Positioned over and secured to the protective layer 806 is a structural support layer 810 comprised of an organic polymer reinforcement composition. The structural support layer 810 and the protective layer 806 are preferably secured together using a primary adhesive layer 812 positioned therebetween which is comprised of one or more of the adhesive compositions listed above.

Finally, positioned over and secured to the structural support layer 810 is a sealant layer 814 comprised of an organic polymer sealant composition. The sealant layer 814 and the structural support layer 810 are attached together using a secondary adhesive layer 816 positioned therebetween which is comprised of the same adhesive compositions listed above and employed within the primary adhesive layer 812. The sealant layer 814 preferably functions as the innermost layer which is exposed to ink materials when the film product 800 is used in a selected ink containment vessel (e.g. vessels 150, 182). Likewise, in accordance with the specific chemical characteristics of the sealant layer 814 as previously discussed, it is readily attachable to surrounding plastic components of common chemical origin within the ink delivery system under consideration using conventional adhesives (including those listed above, as well as standard epoxy resin and cyanoacrylate adhesives). Alternatively, the sealant layer 814 may be secured in position using known thermal attachment processes which employ traditional heat-staking technology.

It should be noted that the film product 800 (FIG. 9) and the film product 600 (FIG. 7) are substantially the same except for addition of the protective layer 806 between the barrier layer 810 and the metallic layer 804 comprised of elemental silver. Use of the protective layer 806 shall occur in accordance with preliminary pilot testing involving the particular ink delivery systems and ink compositions under consideration.

This particular embodiment, as shown in FIG. 9, will involve a layering arrangement wherein the structural support layer 810 is positioned between the sealant layer 814 and the metallic layer 804 comprised of elemental silver, with the metallic layer 804 being positioned between the structural support layer 810 and the barrier layer 802. Furthermore, the protective layer 806 is positioned between the structural support layer 810 and the metallic layer 804 comprised of elemental silver (FIG. 9).

Having set forth specific examples of the film products associated with the present invention, it is again emphasized that the foregoing Examples are representative only. Again, the novel film products described herein (in their most basic form) involve a plurality of material layers including (1) at least one layer comprised of an organic polymer composition; and (2) at least one layer comprised of elemental silver. The dimensional information provided herein is also non-limiting and for example purposes only. Taking into consideration the thickness values listed above in connection with the individual layers used to produce the claimed film products, all of these products (including those shown at reference numbers 300, 400, 500, 600, 700, 800 of FIGS. 4–9) shall have an overall preferred thickness range of about 0.0015–0.005 inches (optimum=about 0.0015–0.004 inches). These values shall likewise be applicable to the side walls used in all of the ink containment vessels produced from the claimed film products (including side wall 160 associated with ink containment vessel 150 of FIG. 1 and side wall 196 used in ink containment vessel 182 of FIGS. 2–3).

Regarding the construction of ink containment vessels from the unique film products described herein, many conventional methods may be employed for this purpose including the use of standard heat-based molding systems which mold the completed film products into a desired shape (e.g. a bladder or bag-type configuration) in accordance with an appropriately-shaped molding member. The selected ink containment vessel may also be assembled from two interconnected halves produced using the claimed film products which are adhered together by conventional adhesive materials (e.g. the adhesive compositions listed above, as well as standard epoxy or cyanoacrylate adhesives) or by known thermal welding/fusion processes. This particular construction technique is illustrated in connection with the ink containment vessel 182 shown in FIGS. 2–3.

C. Additional Information and Methods of Use

In accordance with the information provided above, the claimed film products (including film products 300, 400, 500, 600, 700, 800 presented in FIGS. 4–9) can be employed in connection with the ink delivery systems shown in FIGS. 1–3 (and ink containment vessels 150, 182 used therein) to provide efficient and beneficial results. Likewise, any other ink delivery systems may be used with the film products and ink containment vessels of the present invention provided that they include a printhead comprising at least one ink ejector for expelling ink on demand therefrom. The ink containment vessel (whether positioned within an exterior housing or not) is then operatively connected to the printhead, with the term "operatively connected" being defined above to involve direct physical attachment to the printhead or remote attachment using one or more ink transfer conduits. Likewise, the ink containment vessels discussed herein will encompass any type of ink-holding receptacle having a side wall produced from the claimed film products which, at a minimum, will contain at least one organic polymer layer and at least one layer of elemental silver. In a preferred embodiment, the film products will again include (1) at least one structural support layer comprised of an organic polymer reinforcement composition; (2) at least one barrier layer comprised of a bi-axially oriented organic polymer barrier composition; (3) at least one metallic layer comprised of elemental silver; and (4) at least one sealant layer comprised of an organic polymer sealant composition. Representative layer-ordering arrangements and layer compositions are discussed above in a non-limiting manner along with appropriate assembly methods (which may be achieved using conventional manufacturing processes).

The present invention shall likewise encompass a general method for preventing ink evaporation from an ink delivery system having a directly-attached or remotely-located supply of ink associated therewith. The claimed method is also designed to prevent the introduction of air into the supply of ink and to likewise avoid vessel corrosion problems. This method generally involves the initial step of providing an ink delivery system which includes a printhead having at least one ink ejector for expelling ink on demand therefrom (See FIGS. 1–3). The next step comprises storing a supply of ink within an ink containment vessel that is operatively connected to and in fluid communication with the printhead. The ink containment vessel will again include a side wall which prevents air and volatile ink components from passing therethrough. The vessel is produced from the unique film products discussed above, with all of the information provided in Sections "A" and "B" of the present description being applicable to and incorporated by reference relative to the claimed methods. As previously stated, the side wall of the ink containment vessel is constructed from a film product made from a plurality of material layers secured together with at least one of the material layers being comprised of an organic polymer composition and another of the material layers being made of elemental silver.

In conclusion, the present invention involves a novel ink-resistant film product, an ink containment vessel produced therefrom, an ink delivery system containing the vessel, and methods associated therewith which collectively provide many important benefits. These benefits include (1) the avoidance of ink corrosion problems and ink leakage from the ink delivery system; (2) the prevention of air entry into the ink supply and printhead; and (3) the control of ink evaporation and losses of volatile ink components. As a result, high levels of operating efficiency, print quality, and longevity are maintained in connection with the ink delivery system. Likewise, the unique components and materials discussed herein are applicable to a wide variety of ink printing systems and therefore represent a highly versatile approach in solving the problems mentioned above.

Having herein set forth preferred embodiments of the invention, it is anticipated that suitable modifications may be made thereto by individuals skilled in the relevant art which nonetheless remain within the scope of the invention. For example, the invention shall not be limited to any particular ink delivery systems, ink ejectors, operational parameters, dimensions, ink compositions, and component orientations within the general guidelines set forth above unless otherwise expressly indicated herein. The present invention shall therefore only be construed in accordance with the following claims:

The invention that is claimed is:

1. An ink containment vessel for use with an ink delivery system, said ink containment vessel comprising a side wall which prevents air and volatile ink components from passing therethrough, said side wall comprising a plurality of material layers therein, at least one of said material layers being comprised of an organic polymer composition, and at least one of said material layers being comprised of elemental silver.

2. An ink containment vessel for use with an ink delivery system, said ink containment vessel comprising a side wall which prevents air and volatile ink components from passing therethrough, said side wall comprising a plurality of material layers therein, said plurality of material layers comprising:

at least one structural support layer comprised of an organic polymer reinforcement composition;

at least one metallic layer comprised of elemental silver;

at least one barrier layer comprised of a bi-axially oriented organic polymer barrier composition; and at least one sealant layer comprised of an organic polymer sealant composition.

3. The ink containment vessel of claim 2 wherein said organic polymer reinforcement composition is selected from the group consisting of polyester, nylon, polypropylene, polyethylene, and mixtures thereof, said bi-axially oriented organic polymer barrier composition is selected from the group consisting of bi-axially oriented polypropylene, bi-axially oriented nylon, bi-axially oriented polyester, and mixtures thereof, and said organic polymer sealant composition is selected from the group consisting of polyethylene vinyl acetate, polypropylene, polyethylene, and mixtures thereof.

4. The ink containment vessel of claim 2 wherein said plurality of material layers further comprises at least one protective layer comprised of a hydrophobic composition.

5. The ink containment vessel of claim 4 wherein said hydrophobic composition is selected from the group consisting of polyurethane, a perfluoroated polyacrylate, an epoxy polymer, a silane coupling agent, a silicone polymer, and mixtures thereof.

6. The ink containment vessel of claim 2 wherein said plurality of material layers farther comprises at least one metallic corrosion-control layer comprised of at least one elemental noble metal.

7. An ink containment vessel for use with an ink delivery system, said ink containment vessel comprising a side wall which prevents air and volatile ink components from passing therethrough, said side wall comprising a plurality of material layers therein, said plurality of material layers comprising:

a structural support layer comprised of an organic polymer reinforcement composition;

a metallic layer comprised of elemental silver;

a barrier layer comprised of a bi-axially oriented organic polymer barrier composition; and a sealant layer comprised of an organic polymer sealant composition, said plurality of material layers being arranged so that said barrier layer is positioned between said sealant layer and said metallic layer, with said metallic layer being positioned between said barrier layer and said structural support layer.

8. The ink containment vessel of claim 7 wherein said organic polymer reinforcement composition is selected from the group consisting of polyester, nylon, polypropylene, polyethylene, and mixtures thereof, said bi-axially oriented organic polymer barrier composition is selected from the group consisting of bi-axially oriented polypropylene, bi-axially oriented nylon, bi-axially oriented polyester, and mixtures thereof, and said organic polymer sealant composition is selected from the group consisting of polyethylene vinyl acetate, polypropylene, polyethylene, and mixtures thereof.

9. The ink containment vessel of claim 7 wherein said plurality of material layers further comprises at least one metallic corrosion-control layer comprised of at least one elemental noble metal, said metallic corrosion-control layer being positioned between said barrier layer and said metallic layer.

10. The ink containment vessel of claim 7 wherein said plurality of material layers further comprises a supplemental metal-containing layer comprised of elemental silver and a supplemental sealant-containing layer comprised of said organic polymer sealant composition, said plurality of material layers being arranged so that structural support layer is positioned between said metallic layer and said supplemental metal-containing layer, with said supplemental metal-containing layer being positioned between said structural support layer and said supplemental sealant-containing layer.

11. The ink containment vessel of claim 10 wherein said organic polymer sealant composition in said supplemental sealant-containing layer is selected from the group consisting of polyethylene vinyl acetate, polypropylene, polyethylene, and mixtures thereof.

12. An ink containment vessel for use with an ink delivery system, said ink containment vessel comprising a side wall which prevents air and volatile ink components from passing therethrough, said side wall comprising a plurality of material layers therein, said plurality of material layers comprising:

a barrier layer comprised of a bi-axially oriented organic polymer barrier composition;

a metallic layer comprised of elemental silver;

a structural support layer comprised of an organic polymer reinforcement composition; and a sealant layer comprised of an organic polymer sealant composition, said plurality of material layers being arranged so that said structural support layer is positioned between said sealant layer and said metallic layer, with said metallic layer being positioned between said structural support layer and said barrier layer.

13. The ink containment vessel of claim 12 wherein said bi-axially oriented organic polymer barrier composition is selected from the group consisting of bi-axially oriented polypropylene, bi-axially oriented nylon, bi-axially oriented polyester, and mixtures thereof, said organic polymer reinforcement composition is selected from the group consisting of polyester, nylon, polypropylene, polyethylene, and mixtures thereof, and said organic polymer sealant composition is selected from the group consisting of polyethylene vinyl acetate, polypropylene, polyethylene, and mixtures thereof.

14. The ink containment vessel of claim 12 wherein said plurality of material layers further comprises at least one metallic corrosion-control layer comprised of at least one elemental noble metal, said metallic corrosion-control layer being positioned between said structural support layer and said metallic layer.

15. The ink containment vessel of claim 12 wherein said plurality of material layers further comprises a protective layer comprised of a hydrophobic composition, said protective layer being positioned between said structural support layer and said metallic layer.

16. The ink containment vessel of claim 15 wherein said hydrophobic composition is selected from the group consisting of polyurethane, a perfluoroated polyacrylate, an epoxy polymer, a silane coupling agent, a silicone polymer, and mixtures thereof.

17. An ink-resistant film product which prevents air and volatile ink components from passing therethrough, said film product comprising a plurality of material layers therein, at least one of said material layers being comprised of an organic polymer composition, and at least one of said material layers being comprised of elemental silver.

18. An ink-resistant film product which prevents air and volatile ink components from passing therethrough, said film product comprising a plurality of material layers therein, said plurality of material layers comprising:

at least one structural support layer comprised of an organic polymer reinforcement composition;

at least one metallic layer comprised of elemental silver;

at least one barrier layer comprised of a bi-axially oriented organic polymer barrier composition; and at least one sealant layer comprised of an organic polymer sealant composition.

19. The ink-resistant film product of claim 18 wherein said organic polymer reinforcement composition is selected from the group consisting of polyester, nylon, polypropylene, polyethylene, and mixtures thereof, said bi-axially oriented organic polymer barrier composition is selected from the group consisting of bi-axially oriented polypropylene, bi-axially oriented nylon, bi-axially oriented polyester, and mixtures thereof, and said organic polymer sealant composition is selected from the group consisting of polyethylene vinyl acetate, polypropylene, polyethylene, and mixtures thereof.

20. The ink-resistant film product of claim 18 wherein said plurality of material layers further comprises at least one metallic corrosion-control layer comprised of at least one elemental noble metal.

21. The ink-resistant film product of claim 18 wherein said plurality of material layers are arranged so that said barrier layer is positioned between sealant layer and said metallic layer, with said metallic layer being positioned between said barrier layer and said structural support layer.

22. The ink-resistant film product of claim 21 wherein said plurality of material layers further comprises a supplemental metal-containing layer comprised of elemental silver and a supplemental sealant-containing layer comprised of said organic polymer sealant composition, said plurality of material layers being arranged so that said structural support layer is positioned between said metallic layer and said supplemental metal-containing layer, with said supplemental metal-containing layer being positioned between said structural support layer and said supplemental sealant-containing layer.

23. The ink-resistant film product of claim 18 wherein said plurality of material layers are arranged so that said structural support layer is positioned between sealant layer and said metallic layer, with said metallic layer being positioned between said structural support layer and said barrier layer.

24. An ink delivery system for use in printing images on a substrate comprising:

a printhead comprising at least one ink ejector for expelling ink on demand from said printhead; and an ink containment vessel operatively connected to and in fluid communication with said printhead, said ink containment vessel comprising a side wall which prevents air and volatile ink components from passing therethrough, said side wall comprising a plurality of material layers therein, at least one of said material layers being comprised of an organic polymer composition, and at least one of said material layers being comprised of elemental silver.

25. An ink delivery system for use in printing images on a substrate comprising:

a printhead comprising at least one ink ejector for expelling ink on demand from said printhead, and an ink containment vessel operatively connected to and in fluid communication with said printhead, said ink containment vessel comprising a side wall which prevents air and volatile ink components from passing therethrough, said side wall comprising a plurality of material layers therein, said plurality of material layers comprising:

at least one structural support layer comprised of an organic polymer reinforcement composition;

at least one metallic layer comprised of elemental silver;

at least one barrier layer comprised of a bi-axially oriented organic polymer barrier composition; and at least one sealant layer comprised of an organic polymer sealant composition.

26. The ink delivery system of claim 25 wherein said organic polymer reinforcement composition is selected from the group consisting of polyester, nylon, polypropylene, polyethylene, and mixtures thereof, said bi-axially oriented organic polymer barrier composition is selected from the group consisting of bi-axially oriented polypropylene, bi-axially oriented nylon, bi-axially oriented polyester, and mixtures thereof, and said organic polymer sealant composition is selected from the group consisting of polyethylene vinyl acetate, polypropylene, polyethylene, and mixtures thereof.

27. The ink delivery system of claim 25 wherein said plurality of material layers in said side wall of said ink containment vessel are arranged so that said barrier layer is positioned between sealant layer and said metallic layer, with said metallic layer being positioned between said barrier layer and said structural support layer.

28. The ink delivery system of claim 25 wherein said plurality of material layers in said side wall of said ink containment vessel are arranged so that said structural support layer is positioned between sealant layer and said metallic layer, with said metallic layer being positioned between said structural support layer and said barrier layer.

29. In an ink delivery system comprising a supply of ink for use in printing images on a substrate, a method for preventing the introduction of air into said supply of ink and avoiding the loss of volatile ink components therefrom, said method comprising:

providing an ink delivery system comprising a printhead, said printhead comprising at least one ink ejector for expelling ink on demand from said printhead; and storing a supply of ink within an ink containment vessel operatively connected to and in fluid communication with said printhead, said ink containment vessel comprising a side wall which prevents air and volatile ink components from passing therethrough, said side wall comprising a plurality of material layers therein, at least one of said material layers being comprised of an organic polymer composition, and at least one of said material layers being comprised of elemental silver.

* * * * *

UNITED STATES PATENT AND TRADEMARK OFFICE
Certificate

Patent No. 6,012,807

Patented: January 11, 2000

On petition requesting issuance of a certificate for correction of inventorship pursuant to 35 U.S.C. 256, it has been found that the above identified patent, through error and without deceptive intent, improperly sets forth the inventorship.

Accordingly, it is hereby certified that the correct inventorship of this patent is: David Olson, Corvallis, OR; Edward Z. Cai, Corvallis, OR; and James A. Harvey, Corvallis, OR.

Signed and Sealed this Twentieth Day of November 2001.

ARTHUR T. GRIMLEY
*Supervisory Patent Examiner*
Art Unit 2852

UNITED STATES PATENT AND TRADEMARK OFFICE

CERTIFICATE OF CORRECTION

PATENT NO. : 6,012,807
DATED : January 11, 2000
INVENTOR(S) : Olsen et al.

It is certified that error appears in the above-identified patent and that said Letters Patent is hereby corrected as shown below:

Column 37,
Line 5, delete "farther" and insert therefor -- further --.

Signed and Sealed this

Fourteenth Day of October, 2003

JAMES E. ROGAN
*Director of the United States Patent and Trademark Office*